United States Patent [19]

Robishaw et al.

[11] Patent Number: 4,890,959

[45] **Date of Patent: * Jan. 2, 1990**

[54] TRANSPORTATION AND CONSTRUCTION METHOD

[76] Inventors: Alces P. Robishaw, 9333 Memorial #210, Houston, Tex. 77024; Paul A. Robishaw, 10122 Meadow Lake La., Houston, Tex. 77042

[ * ] Notice: The portion of the term of this patent subsequent to Mar. 3, 2004 has been disclaimed.

[21] Appl. No.: 825,416

[22] Filed: Feb. 6, 1986

Related U.S. Application Data

[63] Continuation-in-part of Ser. No. 757,631, Jul. 22, 1985, abandoned, which is a continuation-in-part of Ser. No. 642,181, Aug. 17, 1984, Pat. No. 4,610,215, and Ser. No. 704,500, Feb. 22, 1985, Pat. No. 4,647,257.

[51] Int. Cl.[4] ..... E02B 17/00

[52] U.S. Cl. ..... 405/204; 405/196; 405/227; 405/218

[58] Field of Search ..... 405/196, 204, 195, 203, 405/224, 227, 228, 218, 221

[56] References Cited

U.S. PATENT DOCUMENTS

| | | | |
|---|---|---|---|
| 2,909,900 | 10/1959 | Suderow . | |
| 3,001,594 | 9/1961 | Suderow . | |
| 3,162,320 | 12/1964 | Hitch et al. . | |
| 3,499,179 | 3/1970 | Weld . | |
| 3,511,057 | 5/1970 | Suter | 405/196 |
| 3,711,902 | 1/1973 | Eggert, Jr. . | |
| 3,980,185 | 9/1976 | Cain . | |
| 3,983,830 | 1/1976 | Morgan . | |
| 4,647,257 | 3/1987 | Robishaw | 405/204 |

FOREIGN PATENT DOCUMENTS

| | | |
|---|---|---|
| 0128976 | 12/1984 | European Pat. Off. . |
| 2651247 | 5/1978 | Fed. Rep. of Germany . |
| 2725060 | 12/1978 | Fed. Rep. of Germany . |

OTHER PUBLICATIONS

Booklet entitled, "Flexigirder Structure Systems", of Robishaw Engineering, Inc., Houston, Tex., p. 25.

Reprint of article titled, "Modular 'jack-up' Platform Debuts in Peru's Amazon Jungle", 8/11/75 by Petroleum Publishing Company.

"Modular Platform Extends Drilling Season", by Rothrock, Jr. and Morgan, *Petroleum Engineer*, May, 1977, pp. 106, 108, 110.

Ad on Flexifloat Construction Systems, 830.Bouwkunde Wegen-en Waterbouw, vol. 33, No. 12, Dec. 1978, Robishaw Engineering, Inc.

*Primary Examiner*—David H. Corbin

*Attorney, Agent, or Firm*—Browning, Bushman, Zamecki, & Anderson

[57] ABSTRACT

A transportation and construction method utilizing construction components of the type comprising vertically spaced pairs of male and female lock assemblies, with vertically reciprocating female locks for locking horizontally extending pin members of the male lock assemblies into receiving sockets of the female assemblies, comprising the steps of transporting a plurality of construction components having such lock assemblies to a construction site in the manner of standard freight containers, emplacing a first such component at the site supported by an underlying earth formation, positioning a second such component adjacent the first component, placing at least some of the female locks in raised or release positions, mating pin members with the respective sockets of the raised female locks, and then lowering the female locks to lock the second component to the first component and support it thereon in cantilever fashion, then extending supports downwardly adjacent the second component into load bearing engagement with the earth formation, and then interlocking the second component to the supports.

32 Claims, 14 Drawing Sheets

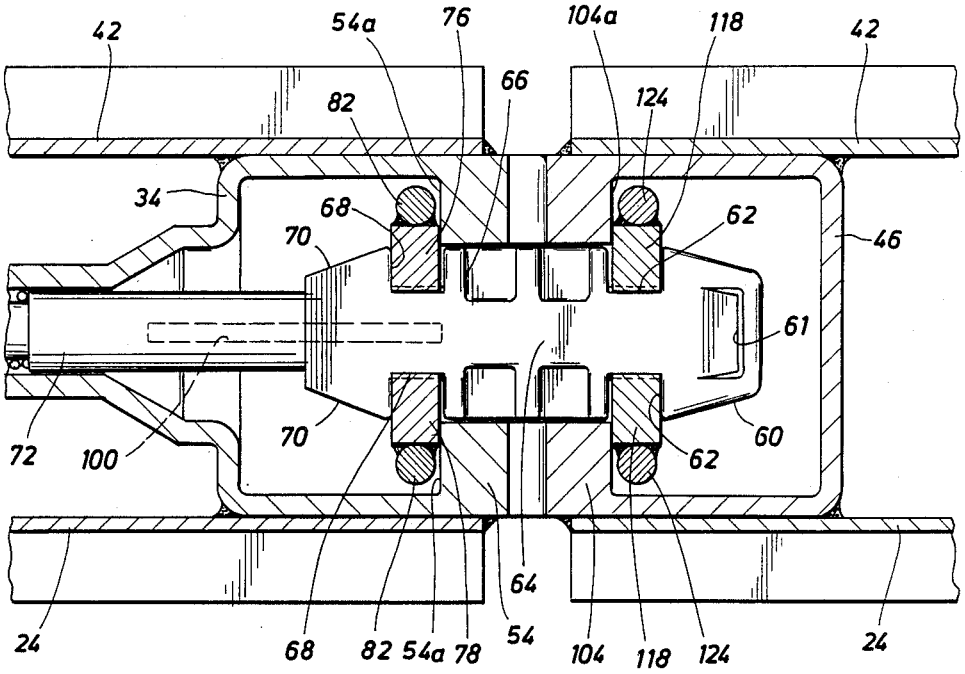
FIG. 16
FIG. 17
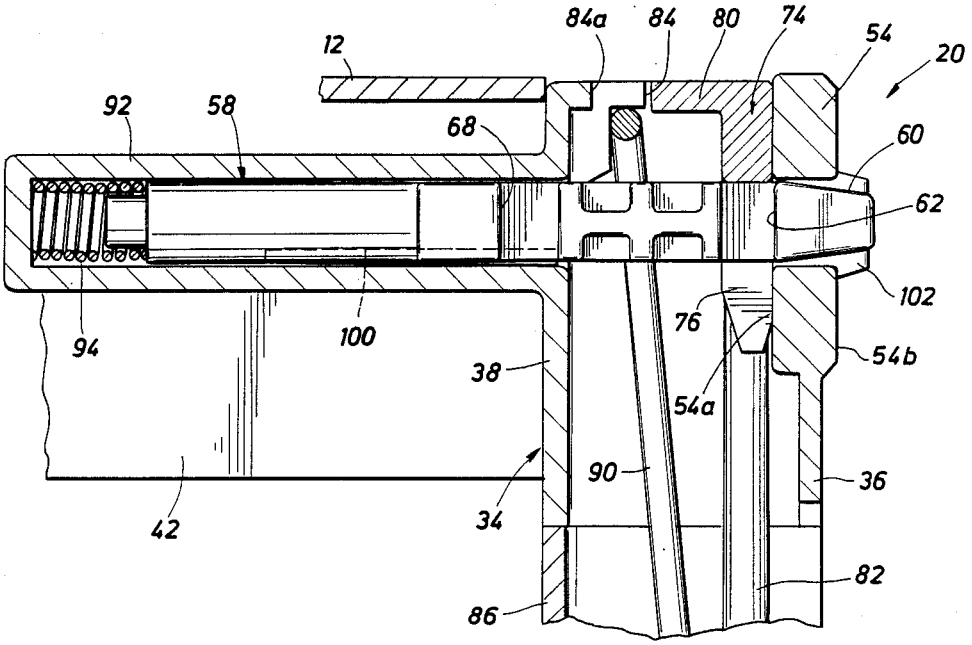

FIG. 18
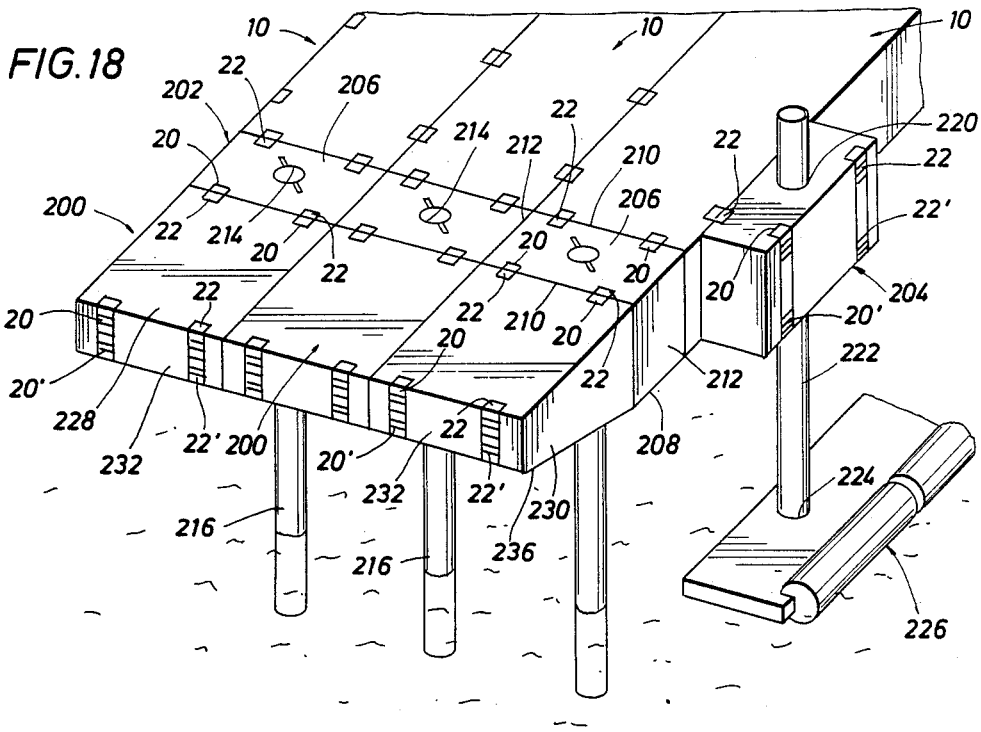
FIG. 25
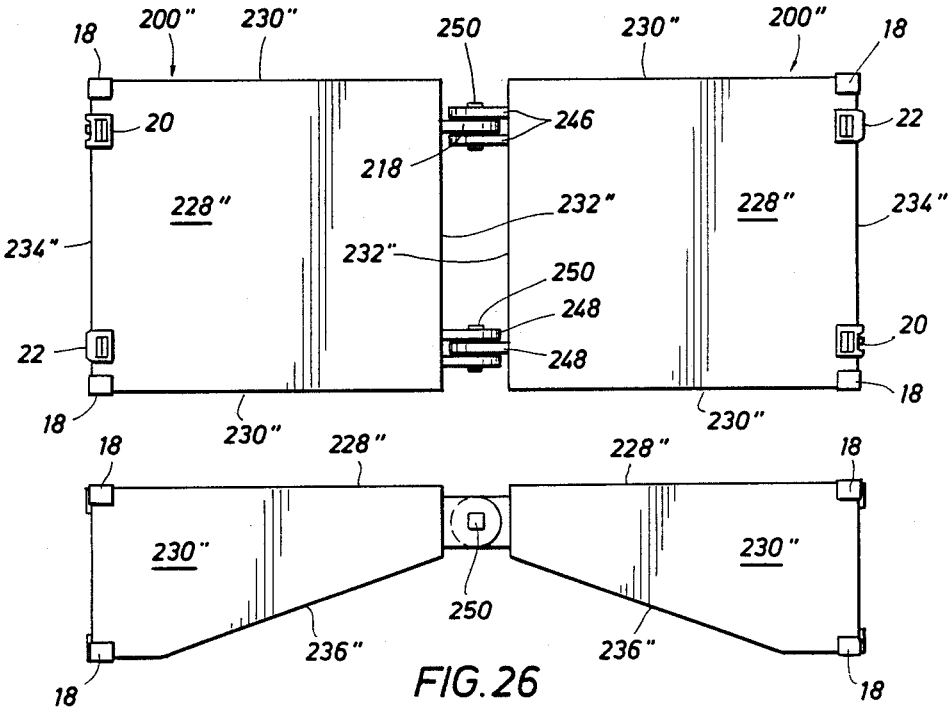
FIG. 26

FIG. 19
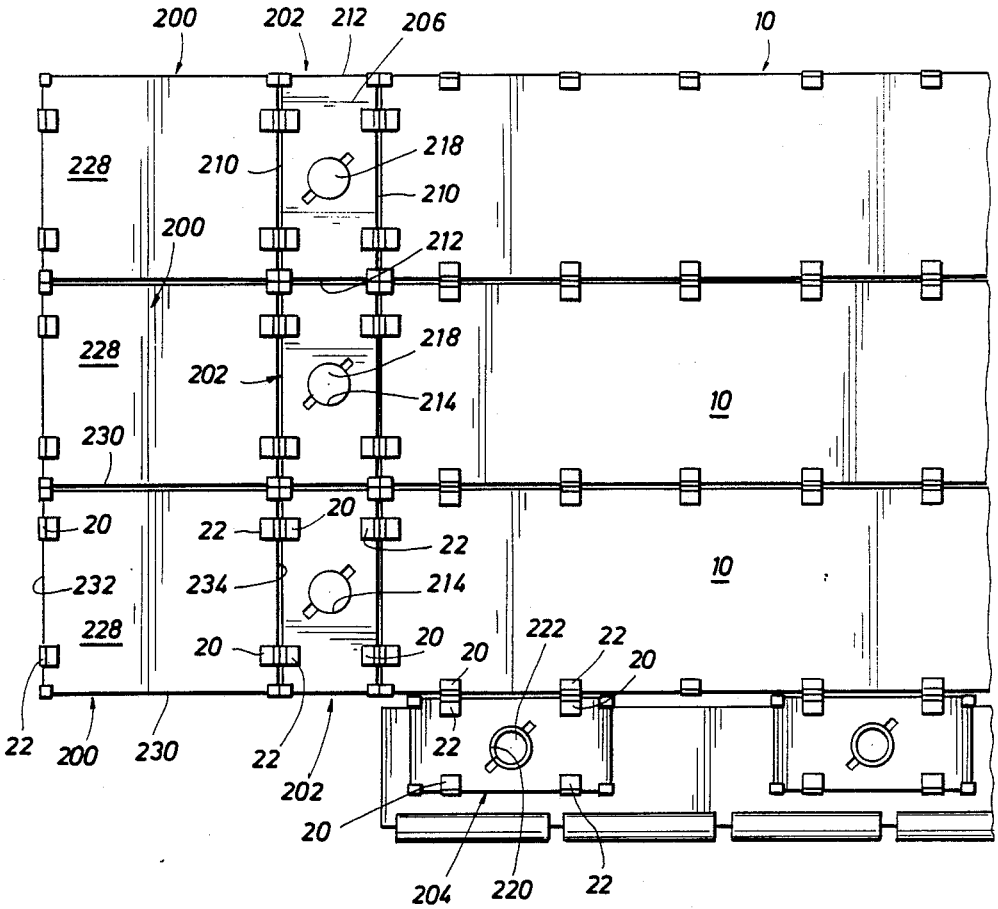
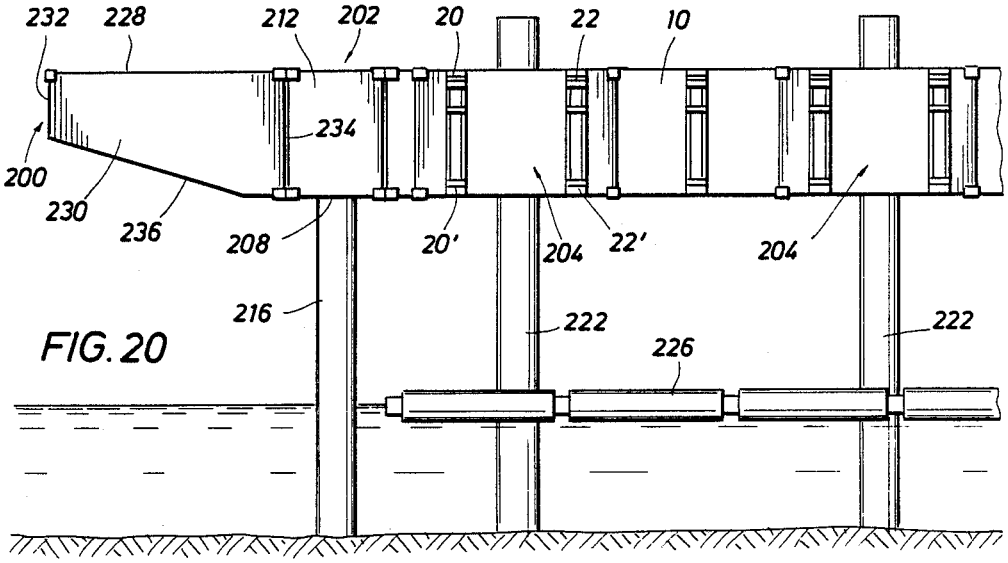
FIG. 20

FIG. 21
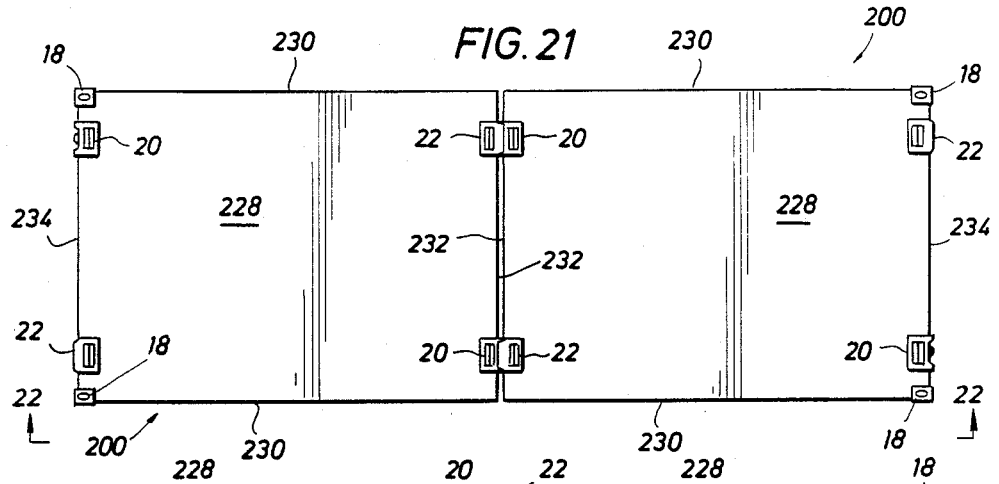
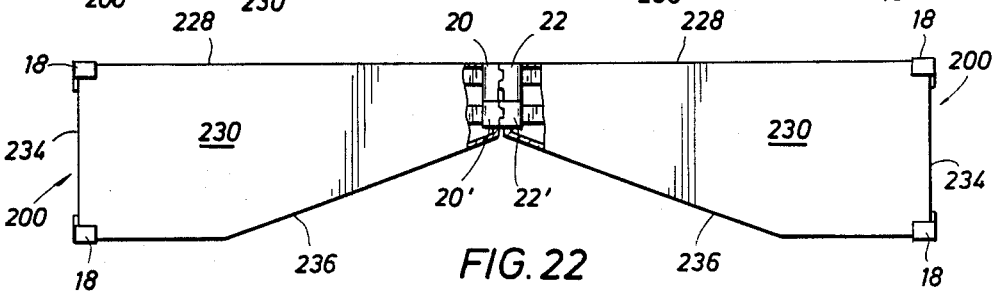
FIG. 22
FIG. 23
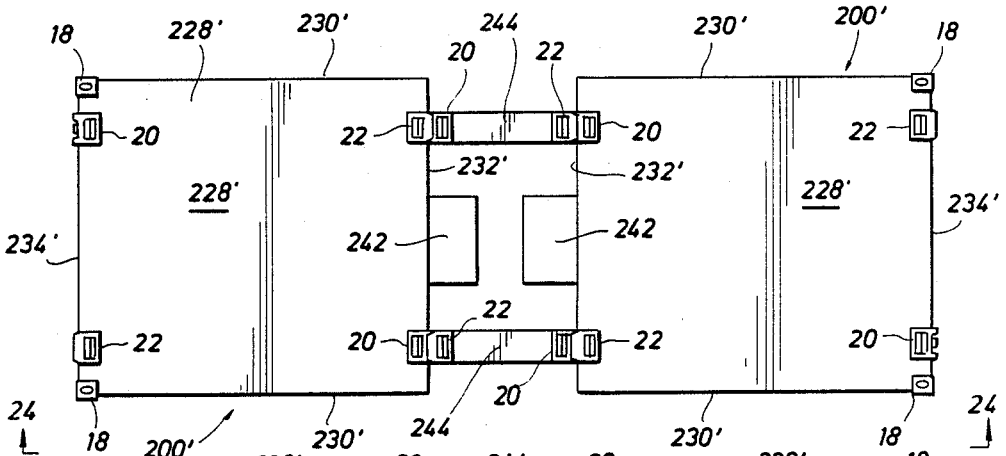
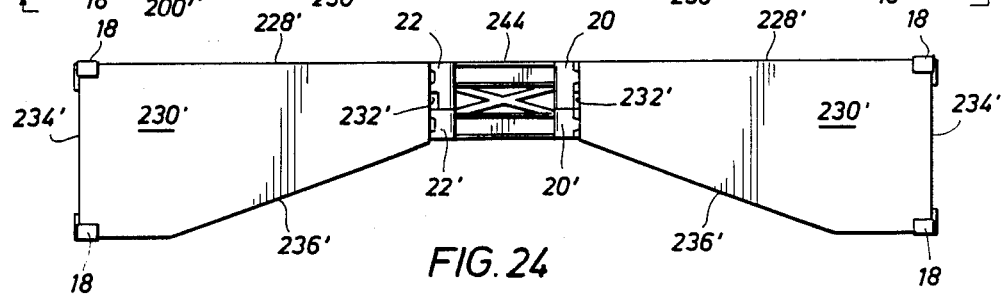
FIG. 24

TRANSPORTATION AND CONSTRUCTION METHOD

CROSS-REFERENCE TO RELATED APPLICATIONS

This is a continuation-in-part of co-pending U.S. application Ser. No. 757,631, filed July 22, 1985, now abandoned, which in turn is a continuation-in-part of U.S. application Ser. No. 642,181, filed Aug. 17, 1984, now U.S. Pat. No. 4,610,215, and is also a continuation-in-part of U.S. application Ser. No. 704,500, filed Feb. 22, 1985, now U.S. Pat. No. 4,647,257.

BACKGROUND OF THE INVENTION

The present invention pertains to the construction of elevated structures such as bridges, piers or docks, offshore structures, and elevated platforms of various types. The method of the invention is useful when it is necessary to build such structures in difficult environments, e.g. over bodies of water. However, it is likewise suitable for many other construction projects, such as the building of overpasses and the like in highway construction.

In the past, it has been known to construct elevated structures such as platforms in relatively shallow bodies of water utilizing buoyant members of a type used to form barges and the like. In some cases, several such buoyant members would be connected together by lock assemblies carried thereon to form a platform. Pilings could be driven through suitable guides on the platform, whereafter the platform was jacked up on these pilings and ultimately locked to the pilings for support thereby.

This scheme still remains desirable for many applications. However, there has been room for improvement in this prior method in connection with the construction of certain types of structures, e.g. long bridges, and/or under certain working conditions or circumstances.

SUMMARY OF THE INVENTION

In accord with the method of the present invention, at least one construction component is emplaced at a construction site supported by an underlying earth formation. Such support may be direct, as where the component rests directly on the ground, or indirect, e.g. by means of suitable pilings or the like. In some instances, one end of the component may be supported directly and the other indirectly.

In any event, the method includes the positioning of a second construction component adjacent the first component. The second component is then supported in cantilever fashion on the first component by locking said second component to said first component. Support means is then extended downwardly with respect to the second component into load bearing engagement with the earth formation. Finally, the second component is interlocked to the support means for support thereby.

In a preferred embodiment of the method of the present invention, the two components are longitudinal components, and the first is so emplaced with both ends thereof supported by the earth formation. The second component is positioned with one end thereof adjacent one end of the first component, whereafter the adjacent ends are locked together to effect the aforementioned temporary cantilevering of the second component from the first component. When the support means are extended from the second component, they are so extended distal that end which is locked to the first component, so that, after the second component is interlocked to the support means, it is then fully supported, i.e. supported at both ends, on the earth formation, whereafter it can be used as a base for further building out of a third component.

Even more specifically, in a preferred embodiment, at least the one end of the first longitudinal component to which the second longitudinal component is connected is elevated above the earth formation. Preferably, the support means comprise pilings extending generally through guide assemblies carried on the longitudinal components and driven into their load bearing engagement with the earth formation.

The method may be performed using a construction system, including relatively simple girders, transom members, and T-head locks, all as disclosed more fully in prior U.S. application Ser. No. 704,500, of which this is a continuation-in-part. The text of application Ser. No. 704,500 is hereby expressly incorporated herein by reference. In another preferred embodiment, the longitudinal components may be of the type disclosed in U.S. patent application Ser. No. 757,631, of which this is a continuation-in-part, and having lock assemblies of the type likewise disclosed therein. The text of application Ser. No. 757,631 is hereby expressly incorporated herein by reference. Spud well components, also disclosed in said application Ser. No. 757,631, may be connected to the general components by such locks to serve as guides for driving the aforementioned pilings. These spud well components are preferably connected to the general components adjacent their longitudinal ends, either directly on their end faces, or on the end portions of their side faces.

More specifically, at least three basic types of construction components may be used in the context of the present invention. These are: (1) the general construction component, a fairly simple component of generally rectangular parallepiped form, which forms one of the basic building blocks of the construction system; (2) rake components, whose undersides are graduated or tapered, e.g. for use at the ends of a bridge which rest on the opposite shores being bridged or on the ends of docks or piers; and (3) spud well components, which are adapted to receive elongate spuds of either the load bearing or locating type, and which can be connected to the other components to adapt them for appropriate association with load bearing or locating spuds or pilings.

A general construction component of the present invention has thereon a plurality of male and female lock assemblies, generally similar to the lock assemblies disclosed in prior U.S Pat. Nos. 2,876,726, 3,057,315, and 3,805,721, arranged in vertically spaced pairs of like gender. These assemblies are adapted for engagement with respective female and male lock assemblies of a similar construction component for locking the two components together, for various purposes, including the temporary cantilevering described above.

One of the main differences between the locking system of the present invention and those of the aforementioned prior U.S. patents is that, in each of the male lock assemblies, the generally horizontally disposed pin member is reciprocable with respect to the construction component between an advanced position in which it protrudes significantly from a lateral wall of that component and a retracted position in which it lies generally within the gross dimensions of the component (i.e. in which it does not protrude from the component by a distance sufficient to interfere with its handling in the manner of a standard freight container). Accordingly, the gross dimensions of the component may be chosen to generally correspond to those of a standard freight container.

Thus, for shipping and handling, the pin members may be disposed in their retracted positions, and the component on which they are carried may further be provided with standard container fittings whereby the container may be lifted, lashed, and otherwise handled in generally the same manner as such freight containers. However, when the construction component has been unloaded at the construction site, the pin members may be placed in their advanced positions for engagement with mating female assemblies of another component to be connected.

The male lock assemblies of each construction component are arranged in tandem pairs, the two male lock assemblies of each such pair being vertically spaced from each other along a lateral wall of the construction component. The female lock assemblies are similarly arranged in tandem vertical pairs. Furthermore, the pin members of the male lock assemblies are rigid. Thus, the present invention is designed to specifically prevent any substantial hinging action between adjacent connected construction components. Nevertheless, the pin members and other movable parts may be made sufficiently small so as to be manually movable with simple hand tools.

It can thus be seen that the present invention provides a scheme which allows the profile of the lock assemblies to be reduced so as not to interfere with shipping and handling of the construction component on which they are carried in the manner of a standard freight container. Nevertheless, after such shipping and handling, substantially horizontally extending pin members may be advanced to provide all of the advantages of the types of lock assemblies generally disclosed in prior U.S. Pat. Nos. 2,876,726, 3,057,315, and 3,805,721.

As compared with the general construction components described above, the specialized construction components of the present invention, specifically the rake components and spud well components, are preferably somewhat smaller than standard freight containers. Nevertheless, it is not practical to place these specialized components within standard freight containers for transportation. Accordingly, the present invention includes a system whereby two or more of these smaller components can be connected together, in some cases along with other auxiliary elements of the transportation system, to form an assembly which, in turn, can be handled and shipped as a standard freight container. Then, when the assembly has reached the construction site, the components can be disconnected from the transportation configuration and reconnected with one another and/or with additional components, of either the general or specialized type, in different configurations so as to form the structure being constructed.

It is highly desirable that the connection means which are used to connect the small specialized components to one another in their transport assemblies be the same connection means which are used to connect various construction components together to form the structure being constructed. More particularly, it is preferred that these connection means include the improved, retractable pin, lock assemblies described hereinabove. As is the case with the general, container sized, construction components, the retractability of the pins prevents those pins not used to connect the transport assembly from interfering with handling of that assembly as a standard freight container.

Furthermore, the rigidity of the pins utilized in these preferred lock assemblies, and the fact that the lock assemblies are arranged in tandem pairs, provides a sufficiently rigid assembly for transportation and handling without the need for the assembly to be enclosed within a container. This is largely due to the aforementioned features of the tandem lock assemblies, with their rigid pins, which tend to prevent relative pivotal movement of components connected thereby, and this effect is further enhanced by shear bearing formations.

It is an important object of the present invention to provide an improved method of forming an elevated structure.

Another object of the present invention is to provide such a method which includes transporting and handling the construction components in the manner of standard freight containers prior to formation of such structure.

A further object of the present invention is to provide such a method in which pin members of the lock assemblies on such construction components are retracted for such transportation and handling, and extended for the formation of such structure, including locking of components in cantilevered configuration.

Still another object of the present invention is to provide such a method in which at least some of said construction components are connected together to form assemblies which may be transported and handled as standard freight containers.

Still other objects, features and advantages of the present invention will be made apparent by the following detailed description, the drawings and the claims.

BRIEF DESCRIPTION OF THE DRAWINGS

FIG. 16 is an enlarged detailed view, taken along the line 16—16 of FIG. 15.

FIG. 17 is an enlarged detailed side view, in cross section, of one of the male lock assemblies with the pin member thereof locked in its retracted position.

FIG. 18 is a perspective view of one end of a dock or pier of a type which can be constructed using the components and system of FIGS. 8 et. seq.

FIG. 19 is a top plan view of the pier of FIG. 18.

FIG. 20 is a side elevation view of the pier of FIG. 18.

FIG. 21 is a top plan view of a transport assembly according to the present invention comprising two rake components.

FIG. 22 is a side elevation view of the transport assembly of FIG. 21.

FIG. 23 is a top plan view of another embodiment of transport assembly comprising two rake components.

FIG. 24 is a side elevation view of the transport assembly of FIG. 23.

FIG. 25 is a top plan view of a third embodiment of transport assembly comprising two rake components.

FIG. 26 is a side elevation view of the transport assembly of FIG. 25.

DETAILED DESCRIPTION OF THE PREFERRED EMBODIMENT

Figure 1:
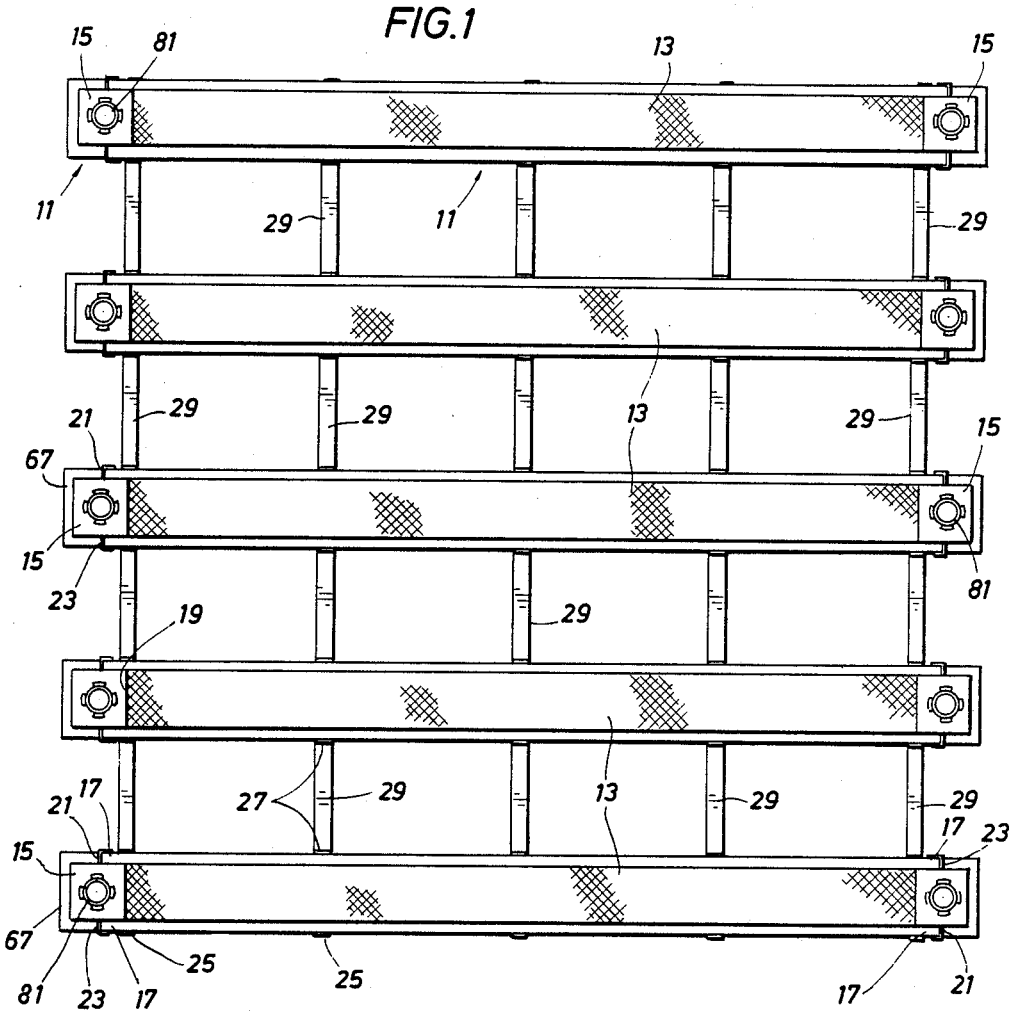
FIG. 1 is a top plan view of a first span of a structure being formed, without decking and prior to elevation to its intended height.

Referring now to the drawing, there is shown one embodiment of the present invention illustrated in the context of an exemplary construction project involving the building of an elevated platform in a shallow body of water. Various aspects of the invention may also be used in connection with many other types of projects, and in other environments, in some cases involving modifications of the exemplary embodiment shown. As used herein, "elevated structure" will mean any structure of which at least part is spaced above the underlying earth formation as by pilings or other supports. Non-exclusive examples include: bridges, overpasses, offshore platforms and piers.

Figure 2:
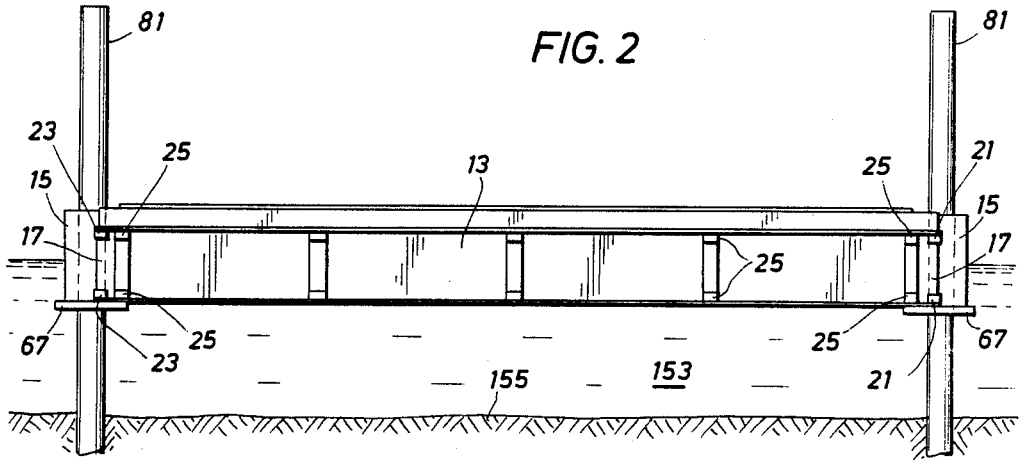
FIG. 2 is a side elevational view of the structure of FIG. 1.
Figure 3:
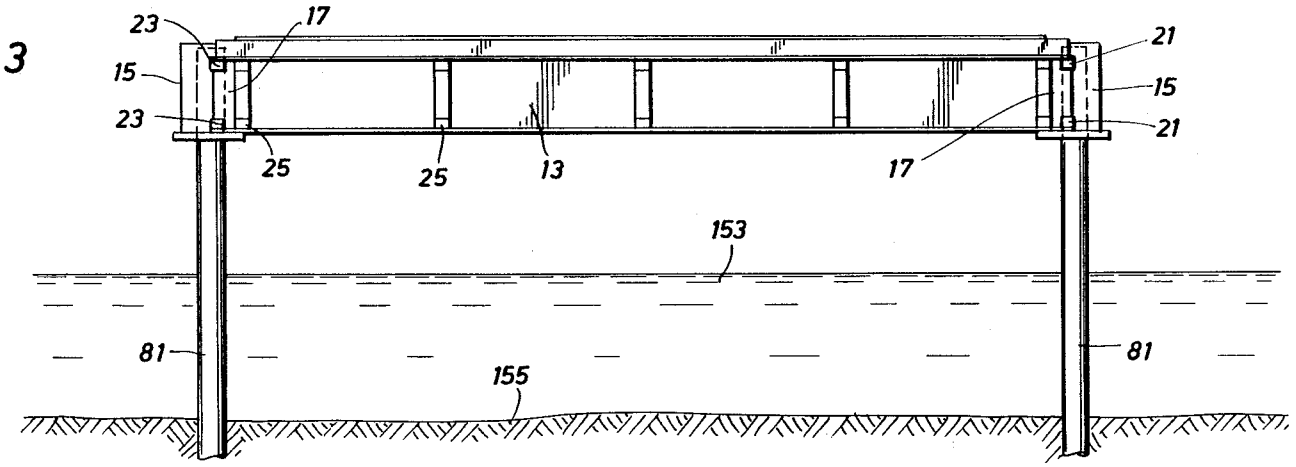
FIG. 3 is a view similar to that of FIG. 2 showing the structure elevated to its intended height.

Referring more particularly to FIGS. 1 and 2, there is shown a first span of the platform to be constructed. This first span comprises five longitudinal construction components 11 connected side-by-side by transom components 29. Each longitudinal component 11 comprises an elongate girder 13 and a pair of pile guide assemblies 15, each of which is affixed to a respective one of the two ends of the girder 13.

More specifically, and referring now also to FIGS. 2–7, each end of each of the girders 13 has a pair of arms 17 extending longitudinally outwardly from opposite lateral sides thereof to define a channel 19 therebetween. The respective pile guide assembly 15 is square in transverse cross section, and the channel 19 is correspondingly shaped to abut the outer sides of the pile guide assembly 15 on three sides. Arms 17 are sized to extend approximately half way across the pile guide assembly 15, so that half the pile guide assembly protrudes endwise from the girder 13.

The outer ends of arms 17 carry primary locking means. At each end of each girder 13, one of the two arms 17 carries a pair of vertically spaced primary female locks 21, and the other arm carries a pair of vertically spaced male locks 23 so that there are a total of four locks on each end of the girder 13.

Each girder 13 also has a plurality of auxiliary female locks 25 mounted on its lateral sides. Transom construction components 29 have, on their ends, auxiliary male locks 27 designed for cooperation with auxiliary female locks 25.

Each of the transom members 29 is generally in the form of a truss including upper and lower horizontal members diagonal bracing members and vertical end members. These members are rigidly affixed to one another in any suitable manner, as well known in the art, e.g. by welding. The girders 13 may take various forms, as will be apparent to one of skill in the art, and in particular may be provided with closure skins of sheet metal so that they may be made buoyant. Girders 13 would typically also include suitable internal struts and/or other reinforcing means, as would be apparent to one of skill in the art.

Figure 6:
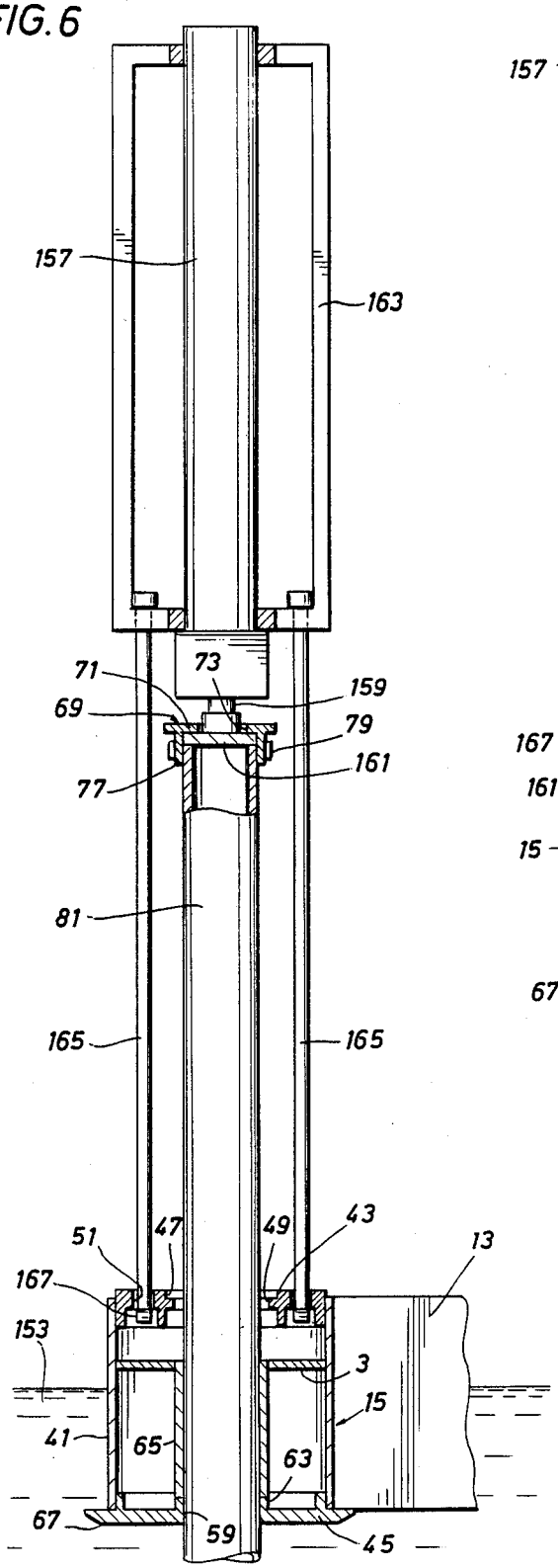
FIG. 6 is a longitudinal view, partly in section and partly in elevation, of a jack assembly which may be associated with one of the guide means and its support member for elevating the first span to its intended height, and showing the apparatus prior to elevation.
Figure 7:
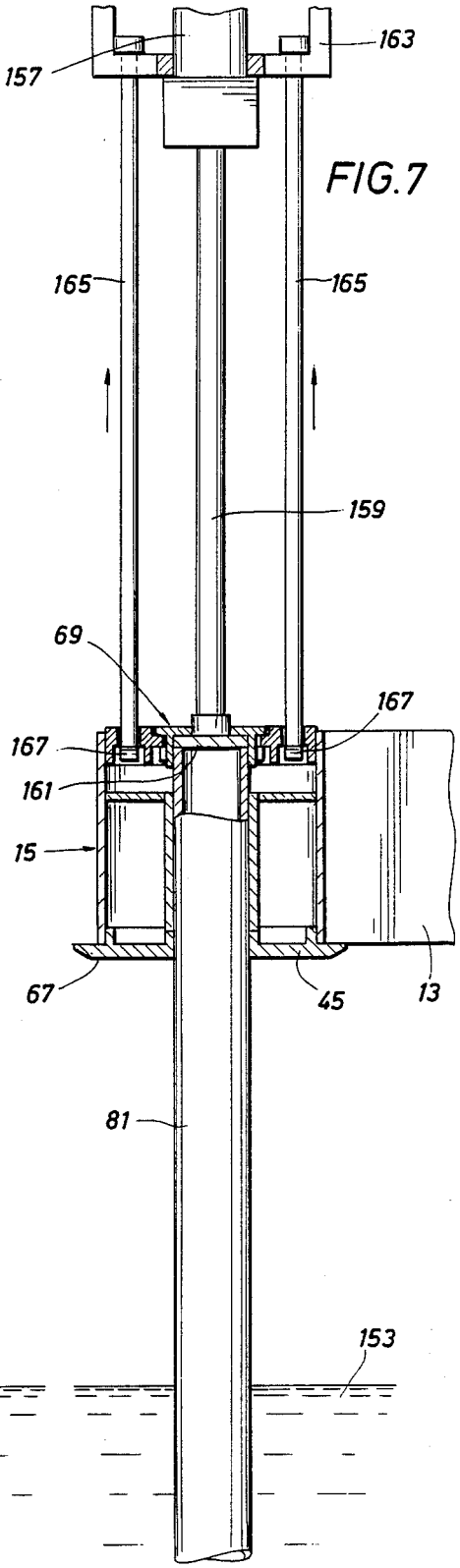
FIG. 7 is a view, similar to that of FIG. 6, after elevation.

Referring to FIGS. 6–7, one of the pile guide assemblies 15 is illustrated in greater detail. The assembly 15 includes a housing or casing comprising side walls 41 which define the aforementioned square transverse cross-sectional configuration. Upper and lower end walls 43 and 45, respectively, are rigidly affixed to side walls 41 in a suitable manner, e.g. by welding.

Upper wall 43 has a central opening 47. Slightly below the upper extremity of upper wall 43, and integral therewith, are a plurality of lips 49 circumferentially spaced from one another about opening 47 and extending radially thereinto. Upper wall 43 is also provided with slots 51 located outwardly of central opening 47 near the four corners of upper wall 43.

Lower wall 45 has a central opening 59 in register with opening 47 of upper wall 43. A short cylindrical skirt or lip 63 extends upwardly adjacent opening 59, and a sleeve 65 of like inner and outer diameters is affixed to and extends upwardly from lip 59 to a point spaced somewhat below upper wall 43. The upper end of sleeve 65 is braced against side walls 41 by a horizontal plate 3. Thus, a central throughway is defined in assembly 15 by opening 59, the interior of sleeve 65, the hollow gap between sleeve 65 and wall 43, and opening 47. A flange 67 integral with lower wall 45 extends laterally outwardly beyond lateral walls 41 so as to form a square rim extending about the entire periphery of the pile guide assembly 15 at its lower extremity. Flange 67 underlies and abuts the end of the attached girder 13 and its arms 17.

An interlock member 69 is associated with upper wall 43 of the pile guide assembly 15. Interlock member 69 includes an upper horizontal plate 71 having a central bore 73 with slots extending radially outwardly therefrom. Member 69 further comprises a cylindrical skirt 77 extending downwardly from plate 73 and spaced inwardly from the outer extremity of plate 71 so that it can pass through lips 49. A plurality of lugs 79 formed integrally with skirt 77 extend radially outwardly therefrom, spaced circumferentially from one another. Lugs 79 are sized so that, if aligned wit the portions of opening 47 between lips 49, skirt 77 can be lowered through opening 47 until the outer edge of plate 71 rests on lips 49. Then, if member 69 is rotated so that lugs 79 underly lips 49, member 69 cannot be withdrawn from bore 49, and conversely, if member 69 is suitably supported, the entire assembly 14 may in turn be supported thereon by virtue of the interengagement of lips 49 and lugs 79 (see FIG. 7).

As will be explained more fully hereinafter, such support of member 69 is provided by support means in the form of cylindrical pilings 81, each of which is associated with a respective one of the assemblies 15. For purposes of the present discussion, it is sufficient to note that skirt 77 is sized to surround piling 81, and that if piling 81 is disposed within assembly 15, plate 71 may rest on its upper end, and with lugs 79 underlying lips 49, member 69 may thus interlock assembly 15 to piling 81 for support thereby. Skirt 77 has a relatively loose fit about piling 81, to avoid jamming, while sleeve 65 and rim 62 may have a closer fit for guiding piling.

The primary locks 20 and 22 and the auxiliary locks 24 and 26 may be of any suitable type including rigid, horizontal pins adapted to serve as at least one means to prevent pivotal or hinging action between adjacent connected construction components, particularly when the lock assemblies are arranged in vertically spaced pairs, as shown. This prevention of hinging or pivoting allows the cantilevering, to be described more fully hereinafter. The lock assemblies may be of the T-head type more fully described in prior application Ser. No. 704,500, of which this is a continuation-in-part, or of the type described more fully below in connection with FIGS. 8 et. seq. Other types of lock assemblies may also be utilized.

Referring now again to FIGS. 1 and 2, an exemplary construction procedure in accord with the method of the present invention will be described. In particular, the exemplary construction procedure will be that of forming an elongate elevated platform in a shallow body of water.

A first span, shown in FIGS. 1 and 2, is formed by assembling construction components in accord with the present invention. This first span includes five of the elongate primary construction components 13, 15 arranged parallel, side by side, and laterally spaced apart. Components 13, 15 are connected in such relation by transom components 29. In particular, each transom component 29 may be lowered into the space between a pair of adjacent girders 13, but offset along the length of the girders 13 from the locus of the auxiliary female locks 25 to which it will be connected.

The transom member is lowered in this offset position until the lower male locks 27 have cleared the upper female locks 25, i.e. are disposed lower than such female locks. Then, the transom member may be moved lengthwise along the girders 13 until it is aligned with the female locks 25. Next, the transom member is further lowered and suitably guided until the upper lock assemblies, 25 and 27, are aligned and the lower lock assemblies 25 and 27 are aligned, whereafter each pair of aligned lock assemblies 25 and 27 are locked together.

The first span may either be pre-assembled or assembled at the construction site. In any event, the span is positioned over the construction site, in this case floating on the body of water 153. Either before or after such positioning, the interlock members 69 are removed from their respective guide assemblies 15, and a piling 81 is lowered through the central throughway of each guide assembly 14. The first span is temporarily anchored in a proper orientation with respect to the bottom 155 of the body of water 153, by well known means (not shown) while pilings 81 are driven downwardly into load bearing relation with bottom 155. This may be done, for example, by suitable power hammer means either supported on the first span itself or on an adjacent platform or vessel. Decking (not shown in FIGS. 1 and 2) may be emplaced on the top of the first span to bridge gaps between the various construction components.

Next, the pilings 81 are cut off at their upper ends, if necessary, so that each extends upwardly by a distance corresponding to the intended height of the finished platform, and interlock members 69 are placed on the tops of respective pilings 81. Then, the first span is elevated on the support pilings 81 by use of jacks. Such jacks may be of any suitable form, and do not, per se, comprise a part of the present invention. However, to clarify the method of the present invention, a simplified form of jack is shown in FIGS. 6 and 7.

Each jack includes a hydraulic cylinder 157 within which is a piston having a piston rod 159 extending outwardly through the lower end of cylinder 157. The lower end of piston rod 159 is provided with a fitting 161 adapted to engage the central opening 73 of a respective one of the interlock members 69. Rigidly affixed to cylinder 157 is a support frame 163. Tie rods 165 are attached to frame 163 and extend downwardly through slots 51 in the upper wall of guide assembly 15. The lower ends of the tie rods 165 are connected to upper wall 43 as by enlarged T-heads 167 which engage the underside of wall 43.

Comparing FIGS. 6 and 7, it can be seen that, as the piston is reciprocated in cylinder 157 in such a direction as to extend rod 159, because rod 159 cannot move downwardly, cylinder 157 will move upwardly, carrying with it frame 163, rods 165 and guide assembly 15. To elevate the first span, a number of such jacks are operated simultaneously in association with respective ones of the guide assemblies 15, until the span has reached the desired height.

Preferably, pilings 81 are pre-cut to an appropriate length so that, when the first span has been elevated to the desired height, their upper edges lie generally flush with the upper surfaces of tongues 49. In any event, with pilings 81 adjusted to the appropriate height, and interlock members 69 in place on their upper ends, the interlock members 69, having been first positioned with their lugs 79 circumferentially offset from tongues 49 for passage therethrough, are rotated to bring lugs 79 into underlying relation to tongues 49. Thus, the interlock members 69 rest on their respective support pilings 81, and the guide assemblies 15 in turn rest on the interlock members 69, specifically their lugs 79, thereby supporting the first span on the pilings.

If decking 5 has not been previously emplaced on the first span, it is emplaced at this time. The structure is now ready for building out a second span from the first span.

The second span will be similar to the first span in that it will be comprised of five parallel longitudinal components interconnected by transom components. However, the primary construction components of the second span will differ from those of the first span in that they will have guide assemblies 15 at only one end of each girder 13'. Using a crane or the like (not shown) which may be supported on the first span, each girder 13' of the second span is positioned in end-to-end relation with a girder of the first span, and in particular, that end of the girder 13' which has no guide means therein is positioned adjacent one end of a girder of the first span so that its channel 19 may surround the portion of the guide assembly 15 protruding from the first girder and the end of the second girder and its arms 17 may rest on flange 67.

A worker standing on the first span may then operate the primary locking means to connect the second girder 13' to the first girder 13 in cantilever fashion. Some vertical shear loading can be transmitted through the locks. However, most of the vertical load may be taken through flange 67 of guide assembly 15 to piling 81.

All girders 13' of the second span are connected endwise to respective girders 13 of the first span in like manner, then to one another by transom components 29. Pilings 81 are then driven downwardly through the guide assemblies 15 distal the first span into load bearing relation with the floor 155 of the body of water 153. Then, utilizing interlock members 69 identical to those described hereinabove, the second girders 13' are interlocked, via guide assemblies 15, to the support pilings 81. When all of the second girders 13' have been emplaced and interconnected by transom members 29, decking 5 may be placed on top of the second span to bridge the gaps between the girders and/or transom components.

Figure 5:
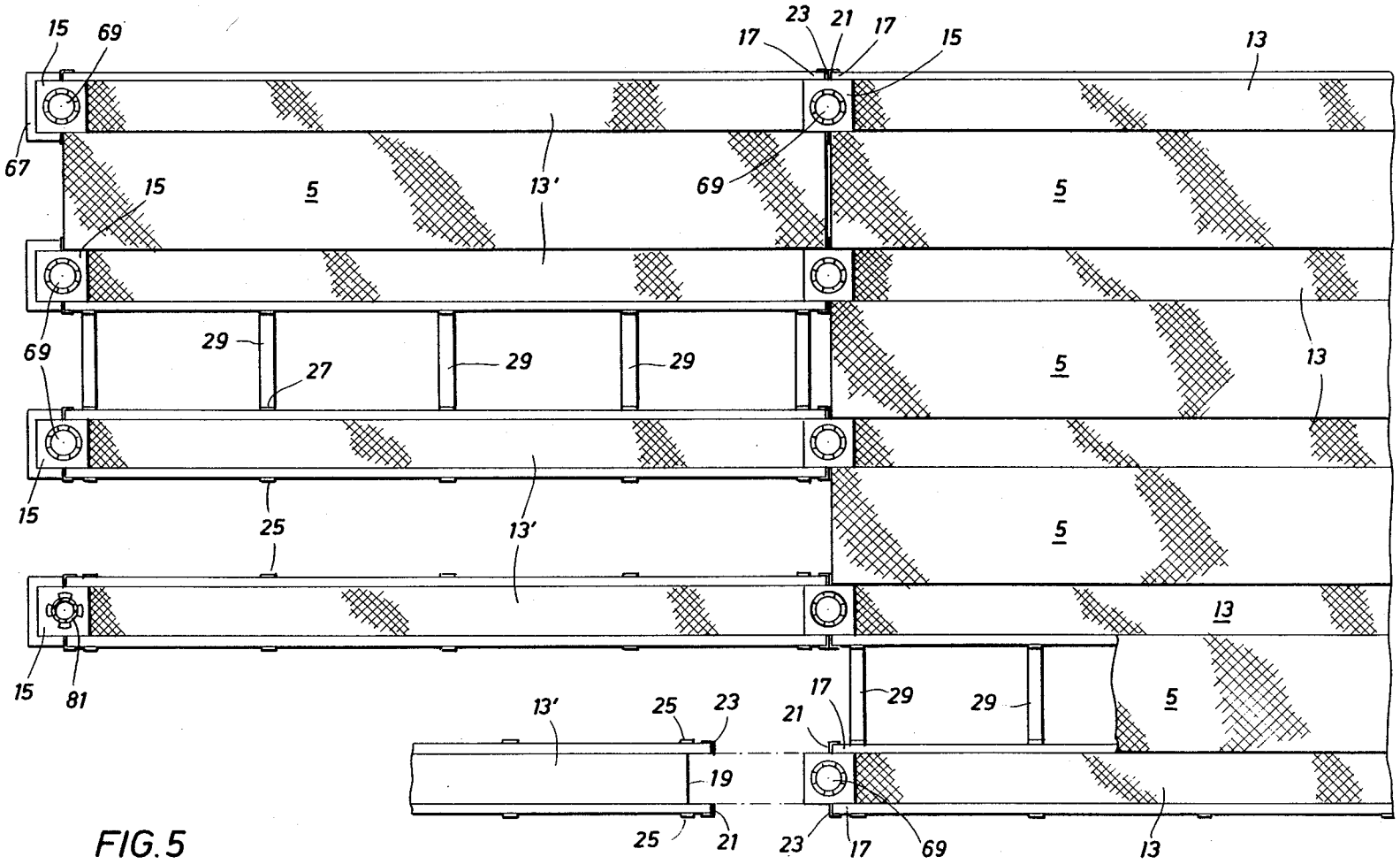
FIG. 5 is a top plan view taken on the line 5—5 of FIG. 4 in which, for convenience of illustration, various portions of the second span are shown in different stages of completion.

The order of construction of the second span is preferably as just described. However, for convenience, FIG. 5 shows laterally adjacent portions of the second span in various stages of completion. Additional spans can be similarly added on to construct a platform of any desired length.

Disassembly and removal, when desired, can be accomplished, in essence, by reversing the steps outlined above. However, the pilings 81 would not ordinarily be completely removed from the underlying earth formation. Rather, a longitudinal construction component to be removed would be disengaged from its piling(s) by removal of interlock member(s) 69. The girder in question would be suitably supported, as by a crane or the like resting on a portion of the structure not yet being disassembled, and the primary locking means would be disengaged to free the longitudinal construction component. The longitudinal construction component would then be lifted vertically upwardly and out of engagement with piling(s) 81 by the aforementioned crane or the like. After a given longitudinal component has been thus removed, any piling or pilings previously associated therewith can be severed at an appropriate level, e.g. adjacent the surface of the underlying earth formation, or in some cases, may simply be left in place.

It will be appreciated that the method may be varied somewhat depending upon the type of structure being formed and the type of earth formation underlying that structure. For example, in some cases, it is not necessary to elevate the first span before adding the second span. In other cases, the entire first span need not be supported on pilings. For example, in constructing a bridge, one end of the first span may rest directly on a bank (and be suitably anchored thereto), and the distal end, below which the bank slopes down toward the body of water, can be supported on pilings, and a second span built out therefrom.

It is particularly noted that the structure can be extended laterally in an incremental fashion using basically the same method as is used for the incremental longitudinal building of the structure, i.e. by supporting a first construction component on the underlying earth formation, locking a second component to the first component in cantilever fashion, extending support means downwardly from the second component into load bearing engagement with the earth formation, and finally interlocking the second component to its support means for support thereby. However, due to the fact that the lateral connections between girders 13 are adapted to be made via the transom members 29, the step of locking the second component to the first in cantilever fashion will preferably be accomplished by first locking two or more transom components to the first component and then locking the second girder in turn to the transom components. Such a modification might be used, for example, where an elongate structure such as a bridge is being built out lengthwise according to the present invention, and at selected points along its length, widened areas are desired, e.g. to serve as pull-out points for vehicles which must, for one reason or another, stop on the bridge. Such modification might also be employed where a structure of irregular configuration is desired for some other reason.

Figure 8:
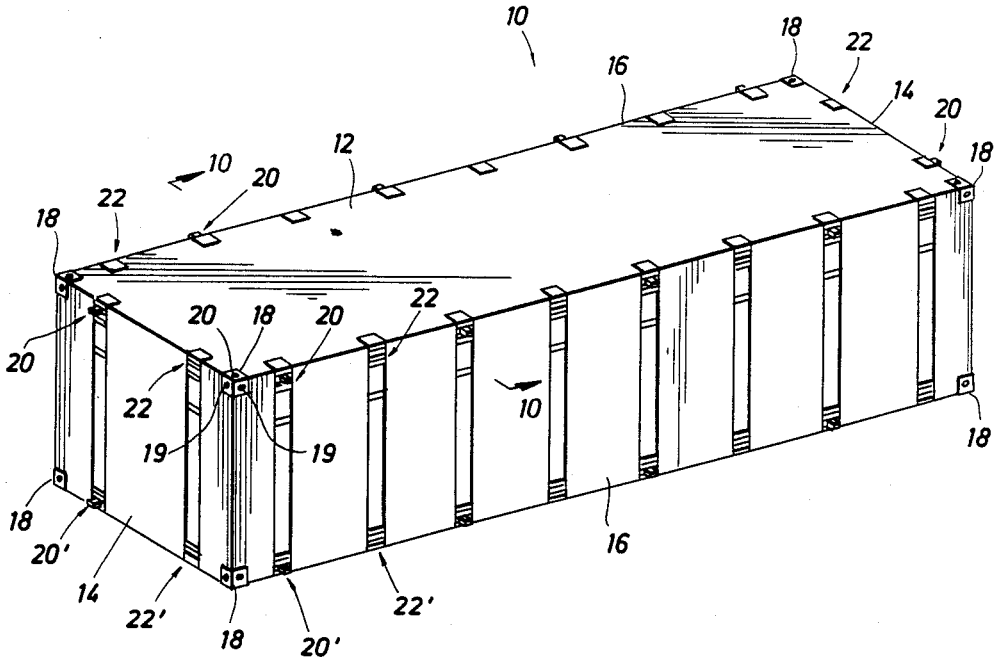
FIG. 8 is a perspective view of another type of general construction component which may be used in practicing the present invention.

The method of the present invention can also be practiced utilizing the types of construction components and lock assemblies illustrated in FIGS. 8–28. FIG. 8 represents a general construction component 10 according to the present invention incorporating improvements in the apparatus described and illustrated in prior U.S. Pat. Nos. 2,876,726, 3,057,315, and 3,805,721. Such improvements will be described in detail hereinafter. Otherwise, the component 10 and the lock assemblies carried thereby may be assumed to incorporate the various features disclosed in said prior U.S. patents. Accordingly, U.S. Pat. Nos. 2,876,726, 3,057,315, and 3,805,721 are hereby expressly incorporated herein by reference.

The construction component 10, as shown, is a buoyant type, so that it may be used in constructing floating bridges, barges, floating piers or docks, floating platforms, and the like. It will be appreciated, however, that the component 10, along with similar components, could likewise be used in the construction of various non-floating structures, such as land supported bridges, platforms, etc. Construction components specifically intended for the latter type usage may or may not be made buoyant, as desired.

More specifically, component 10 is in the form of a rectangular parallelepiped. Component 10 includes an internal force bearing framework, to be described hereinafter, which is generally encased within an outer covering including an upper wall 12, a lower wall 13, and four lateral walls. The lateral walls in turn are subdivided into end walls 14 and side walls 16.

In each corner of the component 10, there is mounted a standard container fitting 18. Such fittings are well known, and in particular, are of the same type which are used in the corners of standard freight containers. Each of the fittings 18 has three intersecting bores 19 into which lifting tools, lash lines and the like can be inserted for lifting and handling the component 10, lashing it in place in racks on a freighter, and otherwise handling the component 10 in the same manner as standard freight containers are handled.

The gross dimensions of component 10, measured between the outer surfaces of its various pairs of opposite walls, generally correspond to those of a standard freight container. For example, the gross dimensions of component 10 may correspond to those of any of the standard size containers listed in the leaflet "ISO Container Dimensions" filed herewith and hereby expressly incorporated by reference. However, it is contemplated that the present invention could be adapted to other container sizes which may become standard in the future.

More specifically, most of the facilities for handling standard freight containers today require standardization only as to the length and width of such containers, whereas vertical depth is not critical. For example, it can be appreciated that, in a storage rack for holding such containers on shipboard, vertical depth would not be critical, as the containers simply stack on top of one another. However, length and width would have to be standardized in order for the containers to fit properly in the racks. Thus, for such standardized systems, a component such as the component 10 would be considered to have gross dimensions generally corresponding to those of a standard freight container if its length and width are approximately equal to the length and width of a standard freight container. However, if for some particular installation, or in some future freight handling system, there is a need to standardize vertical depth, the present invention contemplates that the depth of the components according to the present invention could likewise be chosen to fit such standards.

When it is said that the gross dimensions of component 10 "generally" correspond to those of a standard freight container, it is meant that any projections formed by the container fittings 18 or the various parts of the lock assemblies to be described hereinafter, when those lock assemblies are placed in suitable positions for transport, do not project beyond the outer surfaces of the walls of component 10 by distances such as to interfere with the shipping and handling of component 10 in generally the same manner as a standard freight container.

A plurality of upper and lower male lock assemblies 20 and 20', respectively, and upper and lower female lock assemblies 22 and 22', respectively, are carried adjacent the upper and lower edges of the lateral walls, i.e. end walls 14 and side walls 16. The lock assemblies are arranged in tandem pairs, the assemblies of each pair being vertically spaced so that they are disposed respectively adjacent the upper and lower edges of the particular lateral wall on which they are located. Terms such as "vertical," "horizontal," "top," "upper," and "lower" are used herein for convenience; they refer to the apparatus as shown and as normally used, and should not be construed as further limiting the scope. The assemblies of each pair are of the same gender, and the male and female assemblies are alternated along the length of each lateral wall, and are of an even number. Thus, on each end wall 14 there are two pairs of assemblies, one pair of male assemblies 20 and 20' and one pair of female assemblies 22 and 22'.

Furthermore, the male assemblies 20 and 20' on one of the end walls 14 are disposed across from and aligned with the female assemblies 22 and 22' of the other of the end walls 14. Thus, as may be seen in FIG. 2, one end of a component 10 can be aligned with either end of another similar component 10, and the male assemblies of each of said ends will automatically be aligned with the female assemblies of the other of said ends so that the two can be connected. Similarly, there are eight pair of lock assemblies, alternately male and female, arranged along the length of each of the side walls 16, and each male assembly on one side of the construction component is located across from a female assembly on the other side. Thus, a given side of a component 10 can be connected to either side of another similar component 10.

Figure 9:
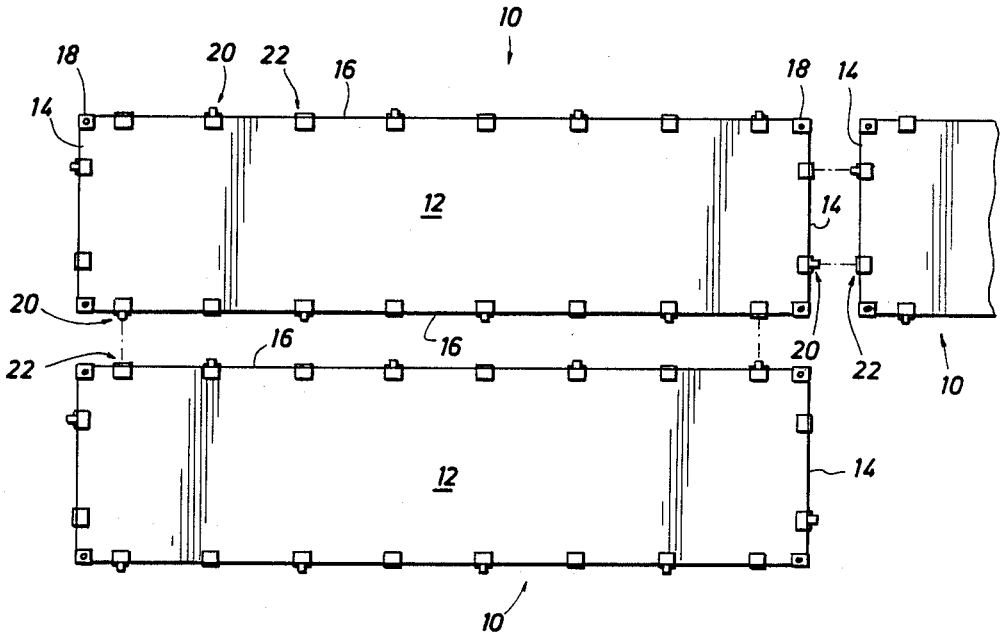
FIG. 9 is a top plan view of several construction components, of the type illustrated in FIG. 8, positioned for prospective connection in one of several possible configurations.

This differs from the arrangements disclosed in said prior U.S Pat. Nos. 2,876,726, 3,057,315, and 3,805,721, wherein all of the assemblies on any given side of the device were of the same gender, and consequently, a given end or side of one component could only be connected to one end or one side of a similar component. Of course, it will be appreciated that FIG. 9 illustrates only one, and that a relatively simple one, of the many configurations in which such components can be connected. It will be noted, in particular, that among the variations are those in which components are connected end-to-side and those in which they are connected side-to-side, but in an offset or staggered manner.

Figure 10:
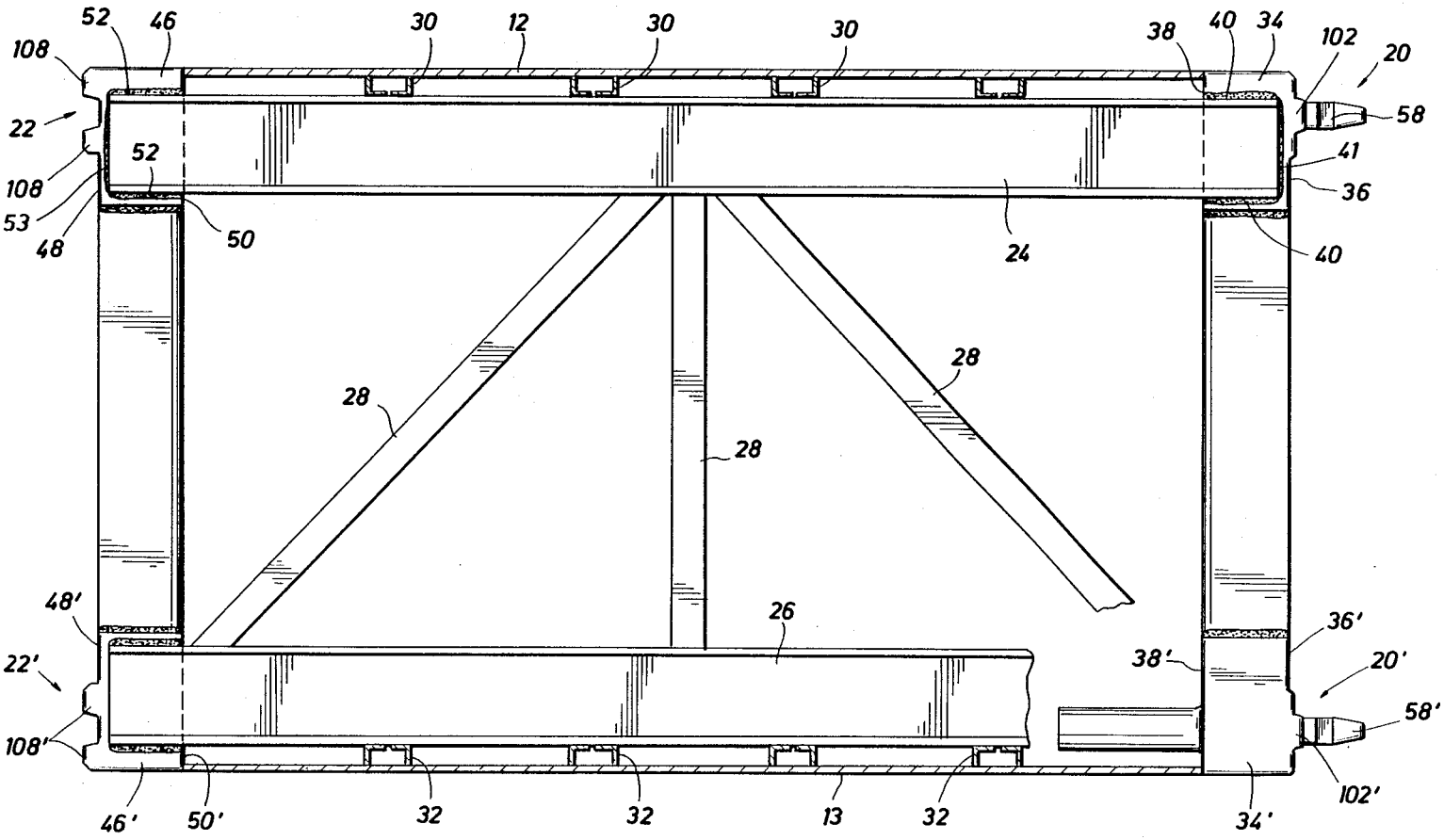
FIG. 10 is a transverse view through the construction component of FIG. 8 taken along the line 10—10 of FIG. 8.

As previously mentioned, the construction component 10 includes an internal structural framework which, as more fully described in the aforementioned prior U.S. patents, may include a plurality of interconnected trusses. An exemplary truss, and more specifically a transverse truss extending from side-to-side within component 10, is shown in FIG. 10. As mentioned, each tandem pair of male assemblies on one side of the construction component is located across from a tandem pair of female assemblies on the other side of the component.

As shown in FIG. 10, such complementary pairs of male and female lock assemblies are mounted at opposite ends of a given transverse truss. The truss shown in FIG. 3 includes parallel upper and lower cords 24 and 26, interconnected by struts 28. As fully explained in prior U.S. Pat. No. 3,057,315, struts 28 are arranged so as to abut cords 24 and 26 at spaced apart locations, so as to enhance the flexibility of the truss. Similarly, rails 30, which space upper wall 12 from the upper extremity of cord 24 and similar cords in other trusses throughout the construction component, abut cord 24 at positions spaced longitudinally from those at which the trusses 28 abut cord 24. Likewise, rails 32 which are disposed between the bottom of lower cord 26 and the bottom wall 13 of the construction component are longitudinally spaced from the locations of abutment of struts 28 with cord 26.

Figure 11:
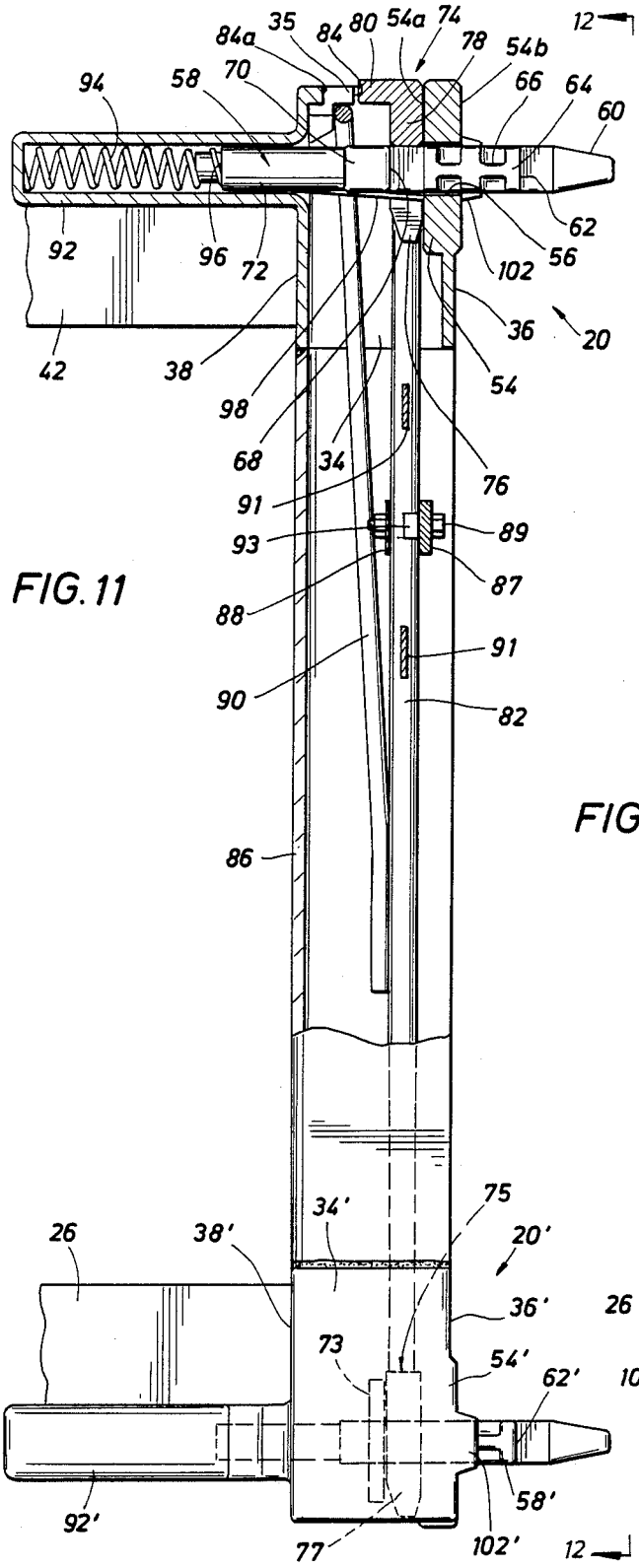
FIG. 11 is a side view, partly in cross section and partly in elevation, of a pair of tandem male lock assemblies of the construction component of FIG. 8.
Figure 12:
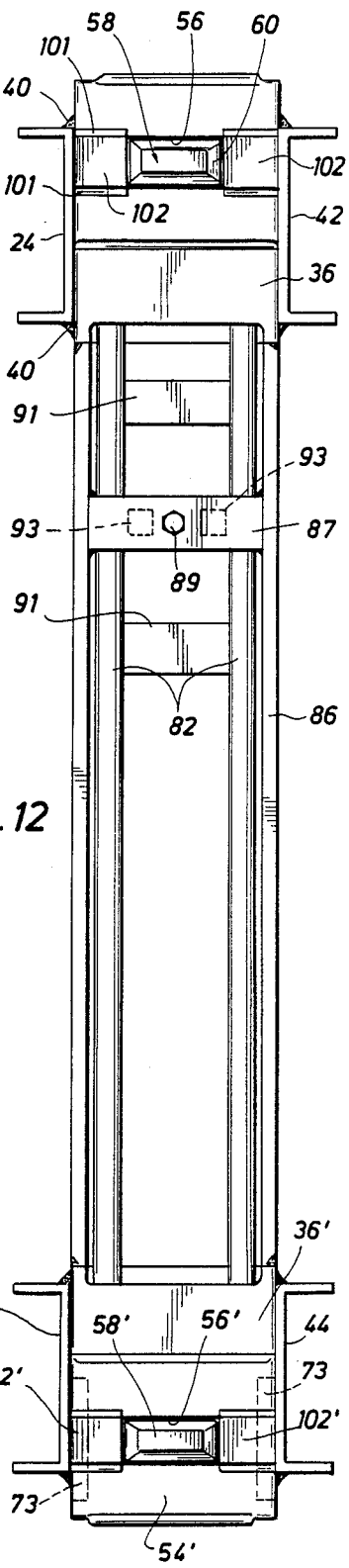
FIG. 12 is a front view of the tandem male lock assemblies, taken generally on the line 12—12 of FIG. 11.

Referring now jointly to FIGS. 10, 11 and 12, each of the male lock assemblies 20 and 20' of the tandem pair shown includes a body in the form of a housing 34 or 34', respectively. Housing 34 will be described in greater detail hereinafter. Housings 34 and 34' are identical, but reversed in orientation so that they are mirror images across a horizontal plane. At this point, it is further noted, that any part of lower male lock assembly 20' which is identical to a part of upper male lock assembly 20 will be designated by the same reference numeral with the character "'" appended thereto. To the extent that the upper and lower male lock assemblies are identical, the lower assembly will not be described in great detail. The same scheme will be utilized in describing upper and lower female lock assemblies 22 and 22'.

Housing 34 has a front wall 36 located near the outer end of the truss in position for general alignment with the respective side wall 16, and a rear wall 38 spaced therefrom inwardly with respect to the truss. Cord 24 is channel-shaped and is welded to one side of the housing 34 of the upper male lock assembly 20 of the tandem pair. Cord 24 is oriented so that its channel faces laterally outwardly with respect to the connected male housing 34. The weld lines 40 extend along housing 34 for a substantial distance in the front-rear directional mode. In addition, there is a weld 41 across the end of cord 24.

Figure 4:
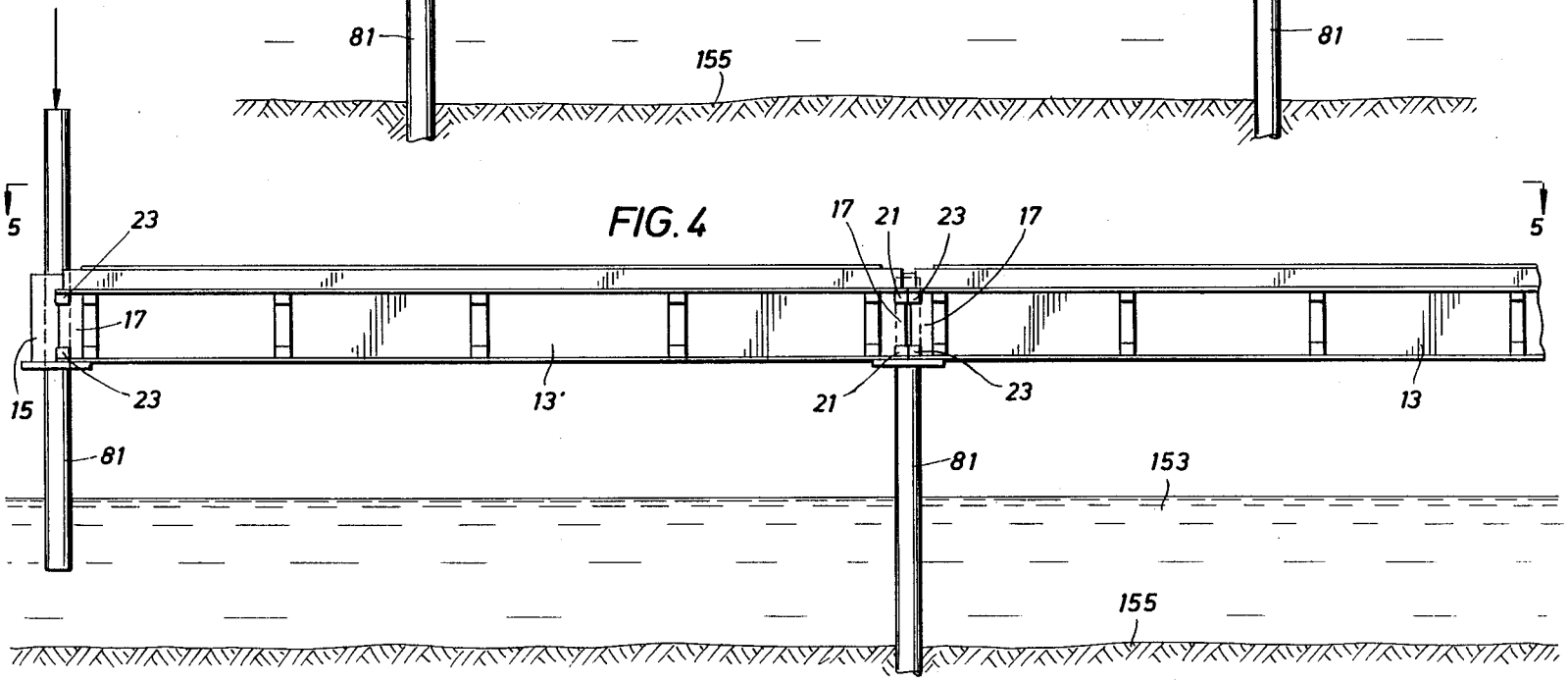
FIG. 4 is a side elevational view showing a second span of the structure being built out from the first span.

As best seen in FIGS. 4 and 5, another channel-shaped cord 42 is welded to the opposite side of the housing 34 from cord 24. Cord 42 forms a part of another truss, which is a mirror image of the truss shown in FIG. 3, and which further includes lower cord 44 and interconnecting struts (not shown). Thus, the housing 34 of the upper male lock assembly 20 is sandwiched between the upper cords 24 and 42 of two adjacent trusses. Similarly, housing 34' of lower male lock assembly 20' is welded between the ends of the lower cords 26 and 44 of the two adjacent trusses.

Figure 14:
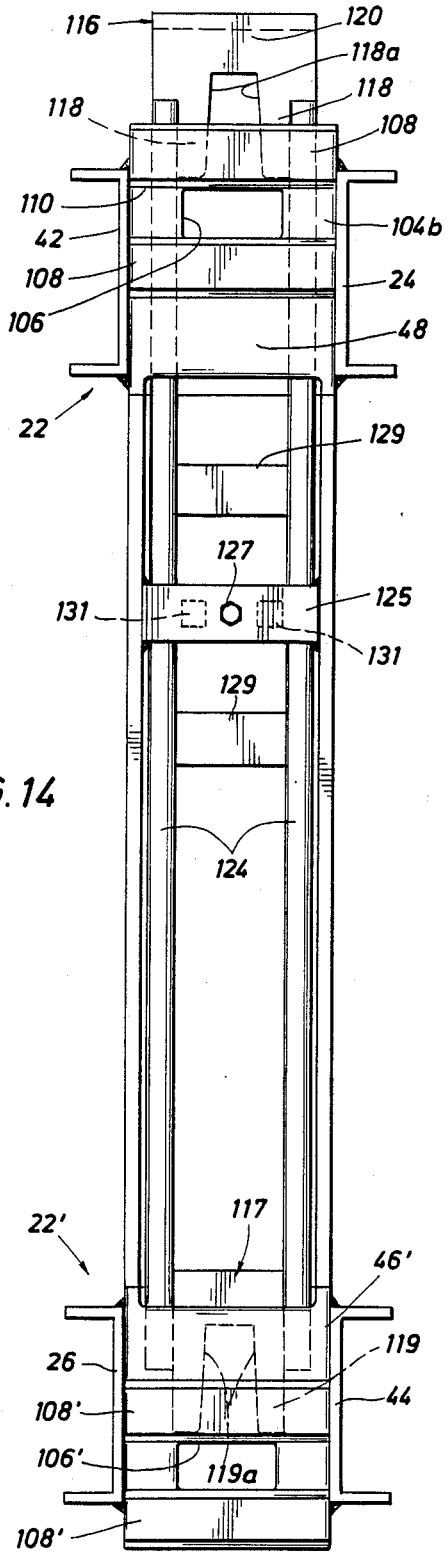
FIG. 14 is a view of the tandem female lock assemblies similar to that of FIG. 12 and taken generally on the line 14—14 of FIG. 13.
Figure 13:
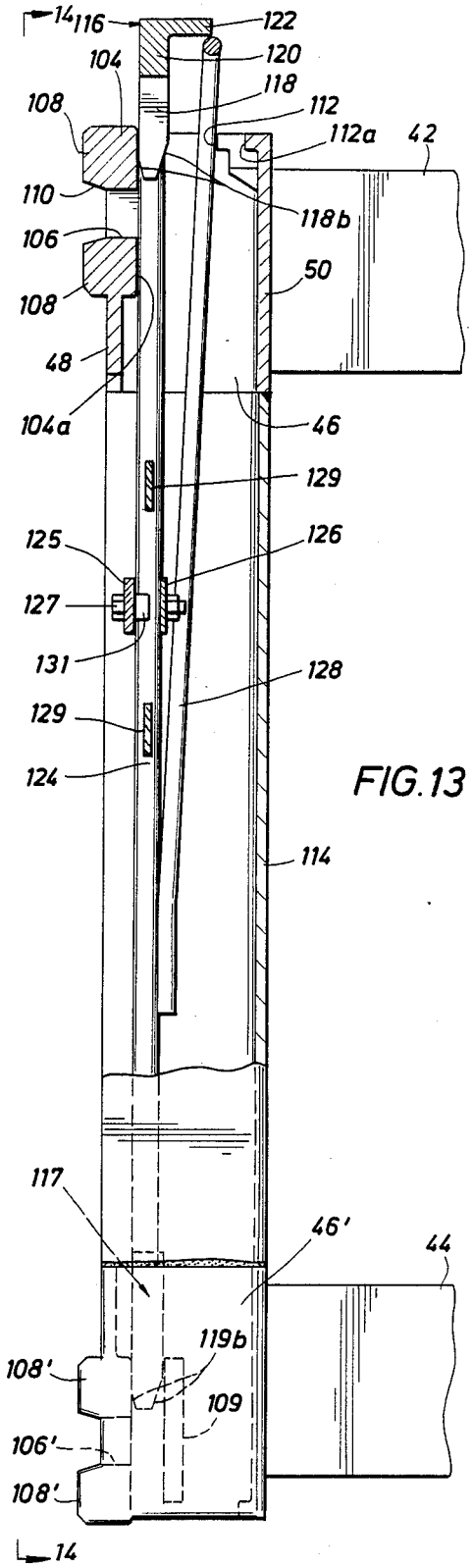
FIG. 13 is a view, similar to that of FIG. 11, showing a pair of tandem female lock assemblies.

Referring now to FIGS. 10, 13 and 14, there is shown a pair of tandem female lock assemblies 22 and 22', each of which includes a female body in the form of a female housing 46 or 46', respectively. (Hereinafter, parts of the male and female lock assemblies which are more or less similar or analogous will be designated "male" or "female" to distinguish between the parts of the two genders of assemblies, and this is not intended to imply that these parts are necessarily of a projecting or receiving type configuration.)

Female housing 46 has a front wall 48 and a rear wall 50 spaced therefrom. Thus, when the upper female housing 46 is welded between the ends of cords 24 and 42 opposite the ends which mount the upper male assembly 20, the weld lines 52 may extend a substantial distance in the front-rear directional mode. There is also a weld 53 across the end of the cord. The female housing 46' of the lower female lock assembly is likewise welded between the ends of cords 26 and 44 opposite those which mount the lower male lock assembly 20'.

Referring now to FIGS. 11 and 12, the male lock assemblies 20 and 20' will be described in greater detail, and it will be understood that all other tandem pairs of male lock assemblies on the component 10, are identical.

The front wall 36 of male housing 34 has a thickened portion 54 which serves as the male socket means and has rear and front walls 54*a* and 54*b*, respectively. Male socket means 54 defines a rectangular male socket opening 56 extending therethrough in the front-rear directional mode. (As used herein, the "front-rear directional mode" will generally refer to a position or direction of orientation parallel to front-to-rear and rear-to-front directions.) As shown in FIG. 12, the transverse horizontal dimension of male socket opening 56 is substantially greater than its transverse vertical dimension.

The male lock assembly 20 further includes a monolithic cast metallic pin member 58 which is slidably received in opening 56 for reciprocation, in the front-rear directional mode, between an advanced position, as shown in FIG. 11, and a retracted position, as shown in FIG. 17. The portion of pin member 58 which is received in opening 56 is generally of a complementary rectangular cross-sectional configuration, of greater horizontal dimension than vertical dimension.

Comparing FIGS. 11, 12, 16 and 17, the outermost or head end of pin member 58 is tapered, as shown at 60, to a somewhat smaller rectangular cross section. Head end 60 has a notch 61 in its upper surface. At the juncture of head end 60 and the larger rectangular portion 64 of pin member 58, there is a first lock engagement region or necked down area including a pair of grooves 62 extending vertically along opposite sides of pin member 58 and opening laterally outwardly. Rearward of grooves 62 is the relatively large rectangular portion 64 of pin member 58, forward or rear portions of which are disposed in opening 56, depending upon whether pin member 58 is in its retracted or advanced position.

Portion 64 of pin member 58 has recesses 66 in its upper and lower surfaces, for a purpose to be described hereinafter. Recesses 66 are not sufficiently large to unduly detract from the load bearing capabilities of portion 64 of pin member 58.

At the rear extremity of large rectangular portion 64 of pin member 58, there is a second lock engagement region or necked down area including vertical grooves 68 substantially identical to grooves 62. Rearward of grooves 68 is a small tapered section 70, which in turn adjoins the cylindrical tail end 72 of the pin member 58. It should be noted that the diameter of tail end 72 does not exceed the vertical dimension of rectangular portion 64 of pin member 58.

Male lock assembly 20 further comprises lock means in the form of a plate-like lock member 74. The male lock member 74 is substantially identical to the female lock member 116 of female lock assembly 22, to be described more fully hereinbelow. Thus, comparison of FIGS. 11 and 12, which show male lock member 74 in its lower or locking position, with FIGS. 13 and 14, which show the identical female lock member 116 in its upper or release position, may facilitate understanding of both male and female lock members.

More particularly, lock member 74 is generally in the form of an inverted U, having downwardly extending tines or rails 76 sized to slidably fit in respective locking grooves 68, or alternatively, in respective locking grooves 62. Rails 76 are joined at their upper ends by a bridge section 78. A tab 80 extends rearwardly from the upper end of bridge section 78.

Lock member 74 is disposed just rearwardly of male socket means 54 in sliding abutment with the rear face 54*a* thereof. An opening 84 in the upper wall 35 of male housing 34 allows lock member 74 to be raised from the locking position shown in FIG. 4, wherein rails 76 are disposed in one or the other of the two pair of locking grooves 62 or 68, to a raised release position, wherein the locking member 74 clears the pin member 58. For this purpose, a suitable tool such as a crowbar, can be inserted in a notch 84*a* in opening 84 and engaged under tab 80.

The lower male lock assembly 20' of the tandem pair has a male housing 34' which is a mirror image of housing 34 across a horizontal plane. Assembly 20' further includes a pin member 58' which is identical to the pin member 58 of the upper male lock assembly 20 and oriented in the same manner. Because the pin members 58 and 58' are identical, and because their locking grooves, e.g. 62 and 68, extend completely therethrough in the vertical direction, it is possible for the lock member 75 of lower male lock assembly 20' to be oriented in the same manner as the lock member 74 of upper male lock assembly 20, i.e. with its bridge section uppermost and its rails or tines extending downwardly therefrom. Lock member 75 is identical to lock member 74, except that it lacks the tab 80 and its rails 77 are longer.

The two lock members 74 and 74' are connected for joint reciprocation between their locking positions and release positions by lock extension means in the form of rods 82 welded to the laterally outer sides of the two male lock members. The lower end of the housing 34 of the upper male lock assembly, and the identical upper end of the housing 34' of the lower male lock assembly are open to permit the necessary movements of rods 82. These open ends of housings 34 and 34' are further rigidly interconnected by body extension means in the form of a channel member 86, as by welding. Guides 73 are welded to housing 34' for cooperation with the rear surface of lower male lock member 75.

A male lock retainer, which is substantially identical to the device 61, 62, 63, 64 shown in prior U.S. Pat. No. 3,805,721, is provided. Briefly, the device includes a base plate 87 which is welded between the sides of channel 86 in a position to slidably engage the front surfaces of rods 82. A nut and bolt assembly 89 connects plate 87 to a spring 88 which is thereby clamped against the rear surfaces of rods 82 to frictionally engage the rods, and thereby, indirectly frictionally engage the lock members 74 and 75. The force with which the device 87, 88, 89 frictionally engages rods 82 is generally sufficient to prevent separation of the lock members 74 and 75 from their respective lock assemblies. In addition, positive stop bars 91 are welded between rods 82, for abutment with blocks 93 carried on plate 87, to positively limit vertical movement and prevent such separation. In addition, the friction device 87, 88, 89 urges the lock members 74 and 75 forwardly against their respective sockets 54 and 54'. Finally, friction device 87, 88, 89 will temporarily maintain the tandem lock member 74 and 75 in any position in which they are placed, and in particular, if they are raised, will temporarily maintain them in a raised position against the force of gravity. Nevertheless, the force with which the friction device engages rods 82 is not so great as to interfere with selective manual raising or lowering of the lock members, with simple tools such as crowbars and hammers, when desired.

To more securely hold the male lock members 74 and 75 in their lowered or locking positions, an inverted-U-shaped latch spring 90 is mounted on rods 82. Spring 90 is substantially identical in structure and function to that of prior U.S. Pat. No. 3,805,721, and thus, will not be described in great detail herein. Briefly, spring 90 is biased rearwardly so that, when the locking members 74 and 75 are in their locking positions, as shown in FIG. 11, the upper end of spring 90 is disposed beneath the upper wall 35 of housing 34 just adjacent opening 84. When it is desired to raise the lock members 74 and 75, a tool can be inserted in notch 84*a* to pry spring 90 forward so that the lock members can be raised. Then, whenever the lock members are again lowered to their locking positions, spring 90 will automatically snap back into a latching position under the upper wall of housing 34.

The rear wall 38 of housing 34 has a pocket 92 extending rearwardly therefrom for sliding receipt of the tail end 72 of pin member 58. A helical compression spring 94 is interposed between the bottom of pocket 92 and a shoulder 96 on the tail end 72 of pin member 58 to bias pin member 58 forward. To retain pin member 58 from being ejected through socket opening 56 or falling out from that opening when the lock member 74 is raised to its release position, a pin retainer in the form of spring 98 is carried on the underside of pin member 58. Spring 98 extends generally longitudinally along pin member 58. Its rear end is anchored on pin member 58, while its forward end is free and biased outwardly away from pin member 58. However, spring 98 can be biased inwardly so that it fits into a groove 100 (see FIG. 16) in the underside of pin member 58.

Thus, in assembling the male lock assembly 20, spring 94 can be inserted through socket opening 56 and into pocket 92. Pin member 58 is then inserted through socket opening 56, such insertion being permitted by the fact that the vertical dimension of pin member 58 nowhere exceeds that which might pass through socket opening 56. As the pin member 58 is being inserted into housing 34 through socket opening 56, spring 98 is cammed inwardly by the lower surface of opening 56 into groove 100. Once groove 100 passes completely through socket opening 56, the forward end of spring 98 will spring outwardly and abut the rear face 54*a* of socket means 54, thereby preventing pin member 58 from falling back out of opening 56. Abutment of spring 98 with rear face 54*a* of socket means 54 also limits forward movement of pin member 58 under influence of spring 94 to a proper advanced position wherein grooves 68 are positioned for engagement by rails 76 of locking member 74. If it is necessary to disassemble the lock assembly, a suitable tool can be inserted through opening 84 to force spring 98 upwardly into groove 100 until pin member 58 has been advanced sufficiently for spring 98 to be held in its groove 100 by the lower surface of socket opening 56.

The rear wall 38' of housing 34' of lower male lock assembly 20' has a pocket 92' identical to pocket 92. As previously mentioned, the pin members 58 and 58' of the upper and lower male lock assemblies are identical, and the pin member 58' of the lower male lock assembly 20' has associated therewith springs identical, both in form and in interrelation with other parts of the lock assembly, to springs 94 and 98. Thus, these springs in the lower male lock assembly 20' will not be shown or further described in detail.

The front wall 36 of housing 34 has a pair of shear bearing lugs 102 formed thereon. Lugs 102 are disposed on opposite sides of socket opening 56. Lugs 102 project forwardly from the remainder of front face 54*b* of socket means 54, but by a distance sufficiently small that they will not interfere with the handling of the construction component 10 on which the lock assembly is carried in the manner of a standard freight container. The upper and lower surfaces 101 of each lug 102 are planar surfaces extending generally horizontally but slightly vertically inclined toward each other for a purpose to be described more fully hereinbelow. Housing 34' of lower male lock assembly 20' has identical lugs 102' thereon.

Referring now to FIGS. 13 and 14, upper female lock assembly 22 will be described in greater detail. The housing 46 of upper female lock assembly 22 is similar to the housing 34 of upper male lock assembly 20 in many respects. Its front wall 48 includes a female socket means 104 having rear face 104*a* and front face 104*b*. A female socket opening 106, substantially identical in size and shape to opening 56 of male lock assembly 20, extends through socket means 104 in the front-rear directional mode.

Front wall 48 of housing 46 differs from front wall 36 of housing 34 in that, rather than the lugs 102, wall 48 has a pair of lugs 108 formed thereon and disposed immediately above and below socket opening 106. For convenience, lugs 108 extend completely laterally across the socket means 104. However, since the purpose of lugs 108 is to engage lugs 102 when the male and female lock assemblies are mated, each lug 108 could be replaced by a pair of lugs spaced apart by a distance corresponding to socket opening 106. Lugs 108 define therebetween a space 110 for receipt of lugs 102. The planar surfaces of lugs 108 which define space 110 are slightly vertically inclined to correspond to the taper 101 of lugs 102.

The rear wall 50 of housing 46 is similar to the rear wall 38 of housing 34 of upper male lock assembly 20 except that it lacks the integral pocket 92. The upper wall of housing 46 is similar to that of the male housing 34, and in particular, includes an opening 112 identical to opening 84 and including a notch **112*a* identical to notch 84*a*. The bottom of housing 46 is identical to that of housing 34, and in particular, is open and is connected by a channel member 114 to the upper end of housing 46' of the lower female lock assembly 22'**.

A female lock member 116, identical to male lock member 74, is mounted for reciprocation with respect to socket means 104 and its socket opening 106 between a raised release position as shown and a locking position in which the rails 118 of locking member 116 are disposed generally on opposite sides of opening 106 and overlapping therewith. In addition to the rails or tines 118, locking member 116 includes a bridge section 120 connecting the upper ends of rails 118, and a tab 122 extending rearwardly therefrom. The structure of member 116 is identical to that of male lock member 74, and the relationships between the member 116 in its locking and release positions, with respect to opening 106, are precisely the same as the analogous positions of members 74 with respect to opening 56.

Locking member 116 is likewise connected to a similar locking member 117 of the lower female lock assembly 22' by rods 124, by welding, for joint reciprocation between locking and release positions. The assembly 116, 124, 117 is identical to the assembly 74, 82, 75 of the tandem male lock assemblies 20 and 20'. Likewise, a frictional retaining device 125, 126, 127 identical to device 87, 88, 89 is provided for assembly 116, 124, 117, as are stops 129, 131 and a latch spring 128, identical to stops 91, 93 and spring 90, both in structure and function.

As with the tandem male lock assemblies, the tandem female lock assemblies shown in FIGS. 13 and 14 differ in that their housings 46 and 46' are reversed or arranged as mirror images of each other, while their respective locking members 116 and 117 are oriented in the same direction, i.e. with their tines extending downwardly. Likewise, locking member 117 of the lower female lock assembly has longer tines 119 but lacks a tab analogous to tab 122 of member 116. Otherwise, the female lock assemblies are identical, and in particular, it is noted that shear bearing lugs 108', identical to lugs 108, are formed on front wall 46', and guides 109 are provided for lower female lock member 117.

The operation of the male and female lock assemblies is as follows. For transport to the construction site, the pin members of the male lock assemblies would be placed in their retracted positions. FIG. 17 shows the pin member 58 of upper lock assembly 20 in its retracted position, and the retracted position of the pin member 58' of the lower male lock assembly would be analogous. As shown in FIG. 17, pin member 58 has been forced rearwardly, compressing spring 94, until the grooves 62 of its first lock engagement region are disposed behind the rear face **54*a* of socket 54 where they are engaged by respective rails 76 of locking member 74**, which has been lowered to its locking position.

As will be explained more fully below in connection with the advanced position of the pin 58, rails 76 are sized to project laterally outwardly from grooves 62 beyond the sides of opening 56 so that they may abut the rear face **54*a* of socket 54. Thus, the rear-to-front force exerted on pin member 58 by compressed spring 94, or any other rear-to-front force which might be exerted on pin member 58, is transmitted through locking member 74 to socket 54, whereby pin member 58 is prevented from advancing from the position shown in FIG. 17. Although further retraction of pin 58 rearwardly from the position of FIG. 17 is not a particular problem, it might be noted that such movement will be limited by abutment of tab 80 of lock member 74 with the edge of opening 84 in housing 34 and abutment of lock member 75 with guides 73**.

The locking member 74 is latched into its lowered or locking position, as shown, by virtue of the fact that spring 90 underlies the top wall 35 of housing 34 adjacent opening 84. It should be noted that, when the lock member 74 is in its locking position, it lies generally flush with the upper extremity of housing 34, which in turn is generally flush with the top wall 12 of the construction component 10 (shown in FIG. 17 but broken away in other Figs. for clarity). The head end of pin member 58 projects forwardly from the front face **54*b* of socket 54 only by a very small distance, generally comparable to that by which the lugs 102 project. As previously mentioned, this distance is not great enough to interfere with transport and other handling of the construction component 10 in the manner of a standard freight container. Thus, with the apparatus in the position of FIG. 17, it will be said that all parts of the male lock assembly lie generally within the gross dimensions of the construction component 10. The pin member 58' will be held in a similar retracted position by its respective locking member 75, as will all other pin members of all male lock assemblies on the construction component 10**.

When the component 10, and similar components to be connected thereto, have reached the construction site, the pin members of those male lock assemblies which will be used to make up the connections between the construction components will be placed in their advanced positions, as shown in FIG. 11, and the locking members of the female lock assemblies to be connected therewith will be raised to their release positions as shown in FIGS. 13 and 14.

More specifically, with respect to the male lock assemblies, and beginning from the position of FIG. 17, a crowbar or other suitable tool is inserted into notch **84*a* in opening 84 in the top wall 35 of housing 34 of the upper male lock assembly 20. In a manner more fully explained in the aforementioned prior U.S. patents, the tool is used to force the upper end of spring 90 forward, until it clears the underside of the top housing wall and is forced under tab 80. By continued movement of the tool, tab 80 can be pryed upwardly, thereby raising locking member 74 and the connected locking member 75 of the lower male lock assembly 20'**. Continued upward movement may be effected, either with the same or another tool, or by hand, once the upward movement has been started in the aforementioned manner.

When the locking members 74 and 75 have been raised a sufficient distance to clear their respective pin members 58 and 58', i.e. to their release positions (which are analogous to those shown in FIGS. 13 and 14 for the female lock assemblies) pin member 58 will be urged outwardly by spring 94, and pin member 58' will likewise be urged outwardly by a similar compression spring (not shown) in pocket 92'. If, for any reason, e.g. breakage of such compression springs, the pins 58 and 58' do not advance from their retracted positions, a simple tool can be engaged in notch 61, or in any of the recesses 66, depending on the current position of the pin member, to force the pin member outwardly or forwardly to its advanced position. Since housing 34' is identical to housing 34, and in particular, has an opening (not shown) in its lower wall identical to opening 84 in the upper wall of housing 34, a similar technique may be used to force pin 58' outwardly or forwardly.

As the portion of pin 58 which, in its retracted position, is disposed in pocket 92, moves forwardly, spring 98 will automatically emerge from its groove 100 in the underside of pin member 58. Spring will engage rear face **54*a* of socket 54 when the pin member 58 is in its advanced position, i.e. with grooves 62 located well beyond front face 54*b* of socket 54 and with grooves 68 located just behind rear face 54*a*, under influence of spring 94. Although spring 98 would not be sufficient to take high tensile loading, it will stop the movement of pin member 58 in the forward direction under the relatively low force exerted by spring 94, and temporarily hold the pin member 58 in that position until lock member 74 can be lowered to its locking position, as shown in FIG. 11. Pin member 58' has an identical spring (not shown) which similarly stops the forward movement of pin member 58'** at its advanced position.

When locking member 74 is lowered, as by striking it with a hammer, the connected locking member 75 will automatically be lowered therewith. Rails 76 of locking member 74 will enter grooves 68, and rails 77 of locking member 75 will enter analogous grooves in lower pin member 58'. Since locking member 74 is sandwiched between rear face **54*a* of socket 54 and the edge of upper housing wall 35 adjacent opening 84, and lock member 75 is sandwiched between socket 54' and guides 73, this position locks the pin members in their advanced positions. The locking rails 76 or 77 of each pair have their inner sides flared outwardly and downwardly, as explained in the aforementioned prior U.S. patents (see also 118*a* and 119*a* in FIG. 14), to tighten the locking engagement gradually. Also, as shown in FIG. 11, for example, the lower end of each rail 76 has its front and rear surfaces tapered inwardly and downwardly to guide the rails into the locking grooves. During the aforementioned lowering of the assembly 74, 82, 75, spring 90 will snap into place beneath the upper wall of housing 34 adjacent opening 84**.

The locking members 116 and 117 of the tandem female lock assemblies 22 and 22' will be raised to their release positions, as shown in FIGS. 13 and 14, in the same manner as was done with the male lock assemblies. Then, with the male lock assemblies in the positions shown in FIGS. 11 and 12, and the female lock assemblies in the positions shown in FIGS. 13 and 14, the construction components on which these assemblies are carried are drawn toward each other, as by ropes or the like, so that pin members 58 and 58' enter socket openings 106 and 106', respectively. The tapered areas 60 on the head end of pin member 58 help to gradually guide the pin member into the female socket opening 106. Because the lugs 108 extend completely across the front face of female housing 46, and in particular, across the upper and lower borders of socket opening 106, tapered areas 110 likewise help to gradually guide pin member 58 into socket opening 106. The same type action occurs in the lower lock assemblies 20' and 22'.

When the assemblies have been thus mated, the grooves 62 of the first lock engagement region of pin 58 will be disposed just behind rear face **104*a* of socket 104 of the mating female lock assembly. Analogous grooves of pin member 58' will be in a like position with respect to lower female lock assembly 22'. By striking the locking member 116 of the upper female lock assembly 22, both locking members 116 and 117 are lowered to their locking positions, to place the apparatus in the condition illustrated in FIGS. 15 and 16**.

It is specifically noted that, as the assembly 116, 124, 117 is being lowered, long rails 119 of the lower female lock member 117 will begin to engage their respective pin member 58' before rails 118 of upper female lock member 116 engage pin 58. Because of the downward and outward flaring of the laterally inner edges **119*a* of rails 119 (see FIG. 14), and the downward and inward tapering of the front and rear surfaces of the rails 119 at their lower ends (see 119*b* in FIG. 13), the lower lock assemblies 20' and 22' will be gradually cammed or wedged into firm mating engagement by the lowering of lock member 117. If the components are connected while floating, this will overcome any tendency of the lower edges of the lateral walls on which the lock assemblies are carried to splay (as the weight of the workers standing near those lateral walls on the upper deck tips or rocks the respective construction components). Thereafter, the upper lock member 116 may readily be fully lowered and engaged with its respective pin member. It is noted, in particular, that if the upper female lock member 116** were permitted to engage its respective pin member too soon, it could provide a pivot point which would increase the tendency of the lower edges of the lateral walls of the two construction components to splay thereby making it difficult to properly mate and lock the lower assemblies.

Figure 15:
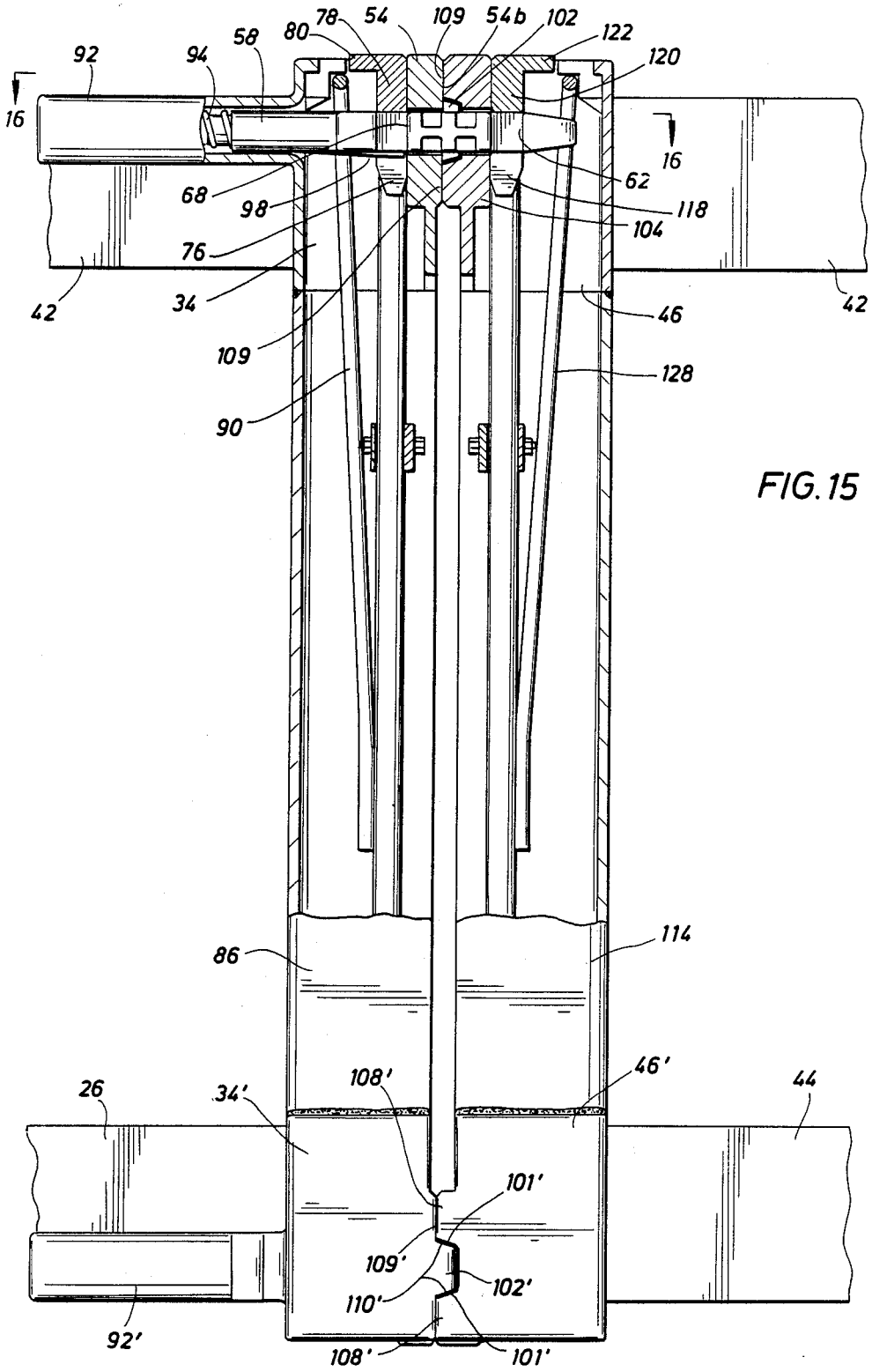
FIG. 15 is a side view, partly in cross section and partly in elevation, showing the tandem lock assemblies of FIGS. 11 and 13 in mated and locked condition.

With the apparatus in the condition illustrated in FIGS. 15 and 16, because rails 118 of upper female locking member 116 are disposed in grooves 62 of pin member 58, but extend laterally outwardly therefrom to abut rear face **104*a* of female socket 104, any front-to-rear force exerted on pin member 58 will be transmitted through locking member 118 to socket 104, whereby pin member 58 is locked into female lock assembly 22**.

If a rear-to-front tensile force is exerted on pin member 58, e.g. if the construction component on which the female lock assembly 22 is carried tends to pull away from the construction component on which the male assembly 20 is carried, such force will be transmitted from the rear face **104*a* of socket 104 through locking member 118 to pin member 58, and from pin member 58 through male locking member 74, to male socket 54**.

When the male and female lock assemblies have been mated and locked together, the shear bearing lugs 102 and 108 of the male and female lock assemblies, respectively, are meshed. Because the shear bearing formations 102 and 108 project and receive in a generally front-rear directional mode with respect to pin member 58, they are capable of transmitting shear forces transverse to pin member 58 independently of that pin member. In particular, the upwardly and downwardly facing surfaces of lugs 102, and the opposed surfaces of lugs 108, while tapered or vertically inclined to help guide the lock assemblies into proper engagement and to ensure, through a wedging action, contact between the male and female shear bearing formations, face generally vertically, and therefore, are capable of transmitting vertical shear loads between the housing 34 and 46 independently of pin member 58.

This arrangement is chosen, especially for components to be used in constructing floating structures such as barges, because the vertical shear forces tend to be greater than the transverse horizontal shear forces.

Likewise, where the components being connected are initially floating, and are later jacked up into an elevated position, as described hereinabove, and thereafter additional components are supported in cantilevered fashion thereon, the shear bearing formations arranged to take vertical loads substantially bear the forces involved in such cantilevered support, particularly since the lock assemblies are arranged in tandem pairs, until pilings can be installed in supporting relation to the temporarily cantilevered parts.

It will be appreciated that the principles of the present invention can likewise be applied to provide shear bearing formations which would transmit horizontal shear forces independently of the pin member. In general, it is desirable that the shear bearing formations be arranged so as to transmit shear loads transverse to the pin member in a direction generally parallel to the path of reciprocation of the locking means, thus they should face generally in such direction.

Returning to the exemplary embodiment illustrated, wherein the shear bearing formations are arranged to transmit vertical shear loads, it can be seen, most notably in FIG. 12, that the transverse vertical dimension of pin member 58 can be substantially smaller than its transverse horizontal dimension, since pin member 58 is relied upon to transmit only horizontal shear loads (which are usually relatively low in the types of construction in question). Thus, a given locking system, comprising a male and female lock assembly, is capable of handling generally greater loads than were previously possible, without a corresponding increase in the overall size and weight of the pin members. Furthermore, by minimizing the vertical thickness of pins 58 and 58', it is possible to maximize the distance between their centers of gravity, and thereby better resist hinging action of the connected components on a horizontal axis.

Because of the use of tandem pairs of lock assemblies, the assemblies of each pair being vertically spaced, and further due to the use of pin members which are formed (preferably monolithically) of metal or like rigid material throughout, the locking system of the present invention is defined to positively prevent any substantial hinging, about a horizontal axis, as between adjacent connected components. This enables such components to be assembled into many types of structures which could not be properly formed with the articulated types of connections exemplified by certain prior art systems. Not only is it possible, with the present invention, to form more stable floating structures, such as bridges, drilling platforms, etc., but it is also possible to form non-floating structures such as land supported bridges and the like, even using the temporary cantilevering technique described above. Nevertheless, and again due to the rigidity of the pin members and their arrangement in vertical tandem pairs, it is not necessary to use unduly large force-transmitting parts in the lock assemblies, and in particular, all moving parts of the lock assemblies, including the pin members and the male and female lock means, are easily manually movable using simple hand tools. The planar configuration of the meshed shear bearing surfaces 101 and 110 further resists any such hinging action.

Another feature which enhances the load handling characteristics of the apparatusis the fact that each of the housings 34 and 46 is integral—preferably monolithic—and has a substantial front-to-rear dimension, i.e. includes a front wall which defines the respective socket means and a rear wall spaced from that front wall. Referring again to FIG. 10, it will be recalled that the weld lines 40 and 52 extend along a substantial front-rear extent of the respective housings 34 and 46. This differs from prior art arrangements in which a single plate-like socket (for a female assembly) or pin base (for a male assembly) was welded to the construction component. The new arrangement provides a better force distribution, and in particular, provides a welded attachment at a position spaced from the socket means, where substantial forces are felt, thereby lessening the chance of failure of one type or another.

All of the above force transmitting interrelationships in the upper assemblies 20 and 22 are duplicated in the analogous parts of the lower assemblies 20' and 22', so that the latter will not be further described in detail. However, it is noted that in FIG. 15, the meshing relationship between the shear bearing lugs 102' and 108' is further illustrated in elevation.

If it is desired to separate the construction components which have been thus connected together, the upper female lock member 116 is raised to its release position, carrying the lower female lock member 117 with it via rods 124. The construction components can then be separated. To provide low profiles for any additional transport or handling of the components, the female lock members can then be relowered into their locking positions, but without any pin members disposed in their respective sockets.

To return the male lock assemblies to a low profile position, the upper male lock member 74 is first raised to its release position, carrying the lower member 75 therewith. Lower pin member 58' of the tandem pair of male lock assemblies is pushed rearwardly or inwardly to its retracted position and temporarily held there manually or by any suitable means. The interconnected lock members 74 and 75 are partially lowered, by striking the upper member 74. Because the rails 77 of lower male lock member 75 are longer than the rails 76 of upper male lock member 74, rails 77 will engage partially within grooves 62' of their respective pin member 58' while rails 76 of upper lock member 74 are still clear of their respective pin member 58. This will temporarily hold pin member 58' in its retracted position while pin member 58 is urged rearwardly to its retracted position. Then, while temporarily holding pin 58 in its retracted position, e.g. manually, the lock members 74 and 75 are further lowered to their full locking positions, wherein both pin members 58 and 58' are firmly locked in their retracted positions, and the locking assemblies 74, 82, 75 in turn is latched in place by engagement of spring 90 with the underside of the top wall of housing 34.

In addition to the general components 10, a complete system according to the present invention may also include various specialized components. FIGS. 18–20 illustrate one end of a pier or dock which has been constructed using general components 10 together with two types of smaller specialized components, i.e. rake components 200 and spud well components 202 and 204. Components 202 have bearing type spud wells similar to those of assemblies 15 of the embodiments of FIGS. 1–7, while components 204 have holding type spud wells. The difference in this regard is a difference in the function of the particular spud well component in the pier or dock, while the spud well components 202 and 204 are otherwise equivalent in terms of the manner in which they are connected to other components either in a construction project or in a transport assembly such as is described more fully below.

The structure of FIGS. 18–20 is only one example of the many uses which can be made of the construction components according to the present invention. In particular, a pier or dock has been constructed with the major portion of its length being formed by general components 10 arranged in spans three abreast. Only the outermost span is shown. It will be understood that there will be as many spans of general components 10 as necessary to construct the dock or pier to the desired length.

The bearing spud well components 202 are each in the form of a rectangular parallelepiped having a rectangular top 206, a bottom 208 and four lateral sides including two relatively long sides 210 lying opposite each other, and two shorter sides 212, likewise lying opposite each other. Each of the components 202 also has a well or throughway 214 extending vertically therethrough, i.e. through its top 206 and its bottom 208.

The longer sides 210 of components 202 each carry two pair of lock assemblies of the type described in detail hereinabove, more specifically, a vertically spaced pair of male lock assemblies, upper ones of which are shown at 20, and a pair of vertically spaced female lock assemblies, upper ones of which are shown at 22. Each of the male lock assemblies 20 lies directly across from a female lock assembly 22, and the spacing between the male and female lock assemblies on a given side 210 of the component is the same as the lateral spacing between pairs of lock assemblies on the general component 10.

Accordingly, each of the bearing spud well components 202 has one of its longer sides 210 connected to the end wall of a respective one of the general components 10 in the outermost span of the pier. Elongate spuds in the form of pilings 216 extend through the wells 214 of respective components 202 and into load bearing relation with the bottom of the body of water over which the pier lies. An interlocking means 218 similar to member 69 of the first embodiment, is installed in each well 214 to interlock the respective component 202 to the respective spud 216, so that the weight of components 202 and adjacent components to which they are attached is borne by the spuds 216. Alternatively, spuds 216 might simply be pinned or welded to components 202. Therefore, members 218 have been shown only diagrammatically, and will not be described in detail herein.

FIGS. 18–20 show only one span of bearing spud well components 202. It should be understood that, throughout the length of the pier or dock whose outer end is shown in the figures, spans of bearing spud well components 202 could be interconnected between spans of general components 10 to provide load bearing capacity at as many points as necessary along the length of the pier. As alternatives to, or in conjunction with such spans of bearing spud well components, and depending on the parameters of the pier or other structure, bearing spud well components 202 could be used at the outboard sides of the spans of general components 10.

In any case, it can readily be seen how the structure could be formed utilizing the method described in connection with FIGS. 1–7. In particular, a first span consisting of several of the general components 10, connected side by side, and with bearing spud well components 202 connected adjacent opposite ends of the span, would be formed. The first span could be elevated to its desired height, supported at that height by the pilings passing through the bearing spud well components 202, and used as a starting point. Next, a second span consisting of components 10 connected side by side, and with bearing spud well components 202 at only one end thereof, could be assembled, emplaced adjacent one end of the first span by a crane or the like supported on that span, and then supported on the first span in cantilever fashion using the lock assemblies 20, 20', 22 and 22'. Pilings would then be placed in supporting relation with the end of the second span distal the first span, via the bearing spud well components, the crane would be advanced onto the second span, and assembly would continue in like manner until the entire structure was completed.

Depending upon the width of the structure being formed, each span would preferably be pre-assembled from components floating on the body of water, by way of contrast to the embodiment of FIGS. 1–7 in which the components to be connected side-by-side in a given span are supported individually on respective components of a previously constructed span, and then locked to one another side by side.

Holding spud well component 204 is virtually identical to the bearing spud well components 202, except that its well 220 need not be adapted to cooperate with an interlocking member to allow the vertical load of the component to be placed on the spud 222 which extends through well 220. Rather, the well 220 need only laterally retain or hold spud 222. Spud 222 in turn extends through a hole 224 of a floating bumper member 226 and into the floor of the body of water therebelow. Thus, spuds 222 laterally position bumper member 226 with respect to the pier and also laterally position the pier with respect to the floor of the body of water. Bumper 226 provides an appropriate abutment for vessels docking at the pier.

In every other respect, component 204 is identical to component 202, and in particular, includes the same number and arrangement of male and female lock assemblies 20, 20', 22 and 22', whereby it is connected to the outermost side of one of the general components 10.

A respective rake component 200 is connected to the outermost side 210 of each of the load bearing spud well components 202. Each rake component 200 has a rectangular top 228 and four lateral sides lying perpendicular to top 228, more specifically, a pair of opposite longer sides 230 and a pair of shorter sides 232 and 234. The bottom 236 of each of the rake components 200 is tapered or graduated, so that the rake component has a deep end adjacent side 234, of the same depth as the other components 10, 202 and 204, and a shallow end adjacent side 232, which forms the outermost extremity of the pier or dock. As used herein, the term "rake component" will generally refer to the types of components illustrated at 200 as well as to ramp-like components which are tapered even more to form a more nearly pointed shallow end.

Side 234 of each rake component 200 has a pair of vertically spaced male lock assemblies 20 and 20', and a pair of vertically spaced female lock assemblies 22 and 22'. The vertical spacing of the lock assemblies in each such pair is the same as that between the components of the various tandem pairs described thus far, and the lateral spacing between the male and female components on side 234 is likewise similar to the lateral spacing between adjacent pairs of lock assemblies in the components described hereinabove. Thus, each rake component 200 can be locked to a respective bearing spud well component 202 as illustrated. In many installations, the cantilever method of support can be used as the only method or permanent method of supporting a span of rake components at one end of a structure, as shown in FIGS. 18–20.

The side 232 of the rake component 200 adjacent the shallow end thereof likewise carries a tandem pair of male lock assemblies 20 and 20' and a tandem pair of female lock assemblies 22 and 22'. Because of the shallow depth of the adjacent end of the rake component, the lock assemblies in each of the two pair carried on side 232, while still vertically spaced apart, are not spaced by as great a distance as the lock assemblies in the other pairs described thus far. This is not disadvantageous in the dock or pier structure, since rake components 200 usually either define a free end of such a structure, as shown, or are connected, shallow end to shallow end, with similar rake components.

A major use of the lock assemblies on side 232 of the rake component 200 is in connecting two such rake components together to form a transport assembly. A preferred form of such a transport assembly is shown in FIGS. 21 and 22. It can be seen that two rake components 200 have been connected together, with their sides 232 facing each other, utilizing the lock assemblies 20, 20', 22 and 22' on those sides. Even though the lock assemblies effecting this connection are not spaced apart vertically by as great a distance as the other lock assemblies described thus far, the facts that they are at least somewhat vertically spaced, that their pin members are rigid, and that they include the shear bearing formations in their housings as described hereinabove, enable them to connect the two rake components 200 in such a manner that they will not pivot relative to one another.

Thus, the transport assembly of FIGS. 23 and 24 can be lifted and otherwise handled in the same manner as a standard freight container. In particular, the maximum value of that dimension of each rake component 200 which is measured horizontally parallel to sides 232 and 234, e.g. adjacent top 228, is generally equal to the width of a standard freight container. A second dimension of each component 200, measured perpendicular to the first dimension, but likewise horizontally, i.e. parallel to sides 230, has a maximum value, adjacent top 228, generally equal to one half the length of a standard freight container. Thus, when the two components 200 are connected as shown to form the transport assembly, its gross dimensions generally correspond to those of a standard freight container. As previously explained, for most current container handling apparatus and the like, the third of the three mutually perpendicular dimensions, i.e. the vertical depth, need not be standardized, but can be chosen as desired.

FIGS. 23 and 24 show another transport assembly of two rake components which might be used, for example, if the rake components in question have their shallow ends equipped with some type of fitting or accoutrement, diagrammatically illustrated at 242, which protrudes horizontally from the shallow end, and thereby prevents the shallow ends of the two components from being directly connected together by their lock assemblies. On the other hand, the scheme of FIGS. 23 and 24 could also be used where it is desired to handle, in the manner of a standard freight container, an assembly of two rake components, where the length of each such component is somewhat less than half the length of a standard freight container.

More specifically, the transport assembly of FIGS. 23 and 24 comprises two rake components 200', which are identical to components 200 except in size and except for the provision of fittings 242. To form the transport assembly, the two components 200' are placed with those sides 232' which lie adjacent their respective shallow ends, facing each other, but not abutting. Sides 232' are connected by means of the male and female lock assemblies carried thereon, but rather than being directly connected, they are connected by spacers in the form of struts 244. Each strut 244 has a pair of male lock assemblies 20 and 20' at one end thereof, and a pair of female lock assemblies 22 and 22' at the opposite end. The pairs of lock assemblies on struts 244 are vertically spaced by the same distance as the lock assemblies in the pairs carried on sides 232' of the rake components. Thus, each strut 244 has one end connected to a pair of lock assemblies on one of the rake components 200', and the other end connected to a pair of lock assemblies on the other of the two rake components 200'.

The length or second dimension of each of the components 200', i.e. that dimension which is measured horizontally and parallel to sides 230', is less than half the length of a standard freight container, but greater than one-third the length of a standard freight container. The length of the spacers or struts 244 is chosen so that the length of the complete transport assembly is generally equal to that of a standard freight container. As in the preceding embodiment, the first dimension, measured horizontally parallel to sides 232' and 234', has a maximum value (and in this case a constant value) approximately equal to the width of a standard freight container.

Although it is sometimes preferable to utilize lock assemblies of the type employed in connecting the components together for construction purposes for the dual purpose of connecting the components together in transport assemblies, it is feasible to use other forms of connection means, particularly at the shallow ends of two rake components, since such ends are frequently not connected to other components in the structure ultimately to be constructed. Thus, an alternative embodiment is illustrated in FIGS. 25 and 26. In that embodiment, the transport assembly includes two rake components 200" which, except for length and manner of connection in the assembly, are identical to components 200. The sides 232" of these modified components adjacent their shallow ends carry, toward one lateral edge, a clevis 246, and toward the other lateral edge, a tongue 248. When the components 200" are placed with their sides 232" facing each other, each tongue 248 can be received in the clevis 246 of the opposite component. Then, the tongues and clevises can be pinned together by pins 250, held in place in any suitable manner, as well known in the art. To brace the assembly against relative pivoting of the two components, pins 250 and the mating holes in tongues 248 and clevises 246 are square in transverse cross section. Suitable bracing members may be used to supplement the anti-pivoting effect of pins 250.

Once again, the first dimension of each component 200'', measured horizontally and parallel to sides 232'' and 234'', has a maximum value approximately equal to the width of a standard freight container. The second dimension of each component 200'', measured horizontally and parallel to sides 230'', has a maximum value, adjacent top 228'', slightly less than half the length of a standard freight container. The dimensions of the tongue and clevis connections 246, 248, when mated, and measured in the same direction as said second dimension, is such as to make the overall length of the transport assembly approximately equal to that of a standard freight container.

Figures 27, 28:
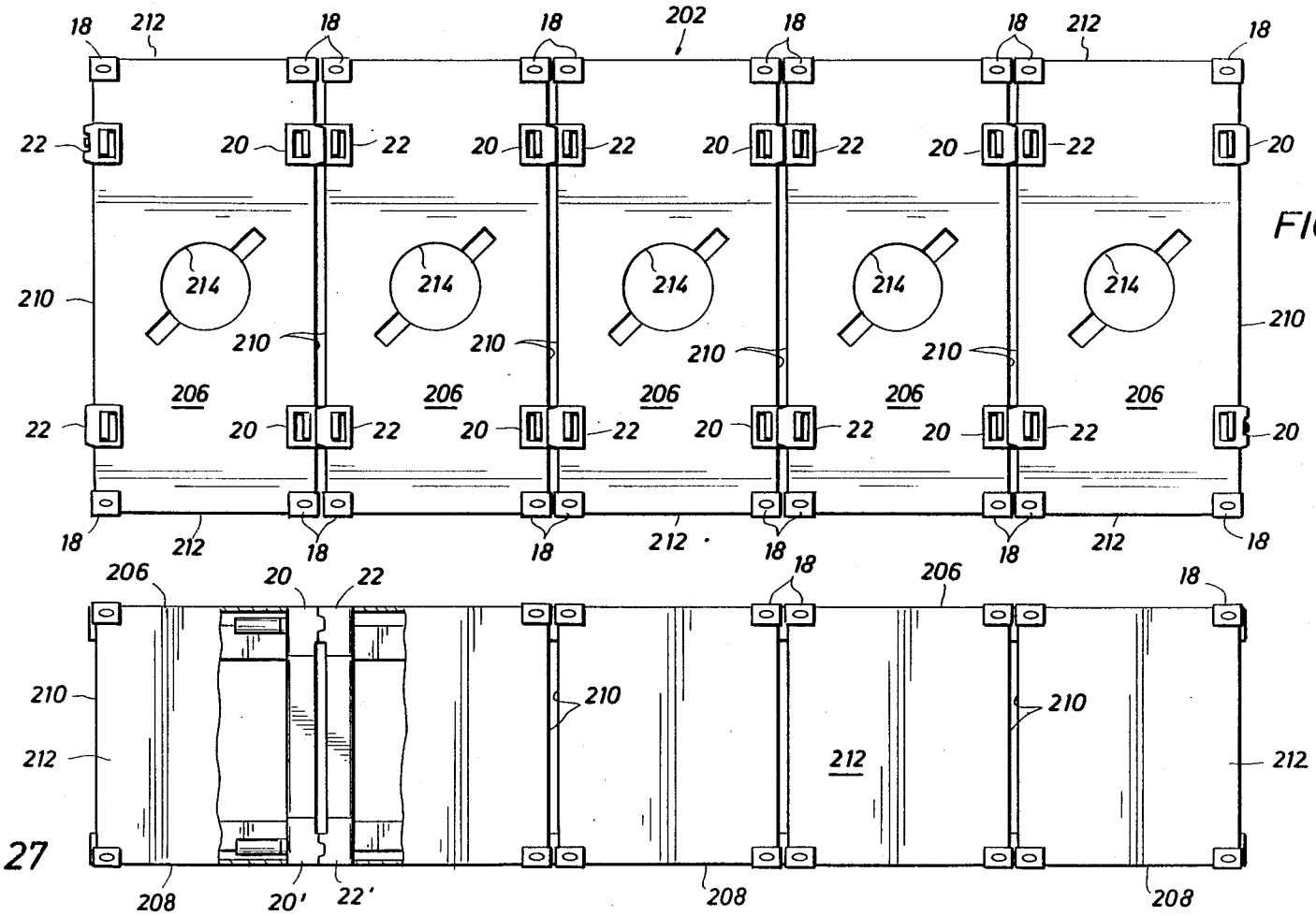
FIG. 27 is a side elevation view of a transport assembly comprising five spud well components.
FIG. 28 is a top plan view of the transport assembly of FIG. 27.

Referring finally to FIGS. 27 and 28, there is shown a transport assembly comprised of spud well components. The assembly illustrated is comprised of bearing spud well components 202. However, it will be appreciated that similar assemblies could be formed utilizing holding spud well components 204, or combinations of the two types of spud well components.

As previously mentioned, the dimension, i.e. first dimension, of each component 202 which is measured horizontally and parallel to its longer sides 210, is equal to the width of a standard freight container. Said sides 210 of the components are also the sides which carry the lock assemblies 20, 20', 22 and 22'. Thus, by placing a set of components 202 in alignment, with each component having a side 110 facing a similar side of the next component or components, and by choosing an appropriate number of the components 202, an assembly can be built up to have gross dimensions generally corresponding to those of a standard freight container. It is particularly convenient to simply connect adjacent components together utilizing the same lock assemblies 20, 20', 22 and 22', which are used to connect the components to other components in construction jobs. As was the case with the rake components 200, any male lock assemblies which are facing outwardly and unused in the transport assembly, should have their pins placed in the retracted or low profile positions.

It is particularly convenient to design the components 202 so that their second dimensions, measured horizontally parallel to short sides 212, is approximately one-fifth the length of a standard freight container. Thus, when five of these components are connected together as shown, the overall length of the resulting transport assembly is approximately equal to that of a standard freight container. Since each of the components 202 is already generally in the form of a rectangular parallelepiped, such sizing permits the assembly to be formed without the need for spacers or the like.

Of course, other relative sizing arrangements are possible. For example, the shorter of the horizontal dimensions of each component could be made approximately one-fourth the length of a standard freight container, with four components being connected together to form each transport assembly. In any event, however, and whether referring to the spud well type components or the rake components, or even other types of specialized components, the requirements for sizing can be generalized as follows.

Each such component must have a first horizontal dimension with a maximum value generally equal to $C_1/x$, where $C_1$ is the width of a standard freight container, and x is less than or equal to 1. In other words, the first dimension of each component must be less than or equal to the width of the standard freight container. However, in order to minimize or even avoid the need for spacers, frame members and the like, it is highly preferable that x be an integer, and in most cases, that x be equal to 1.

Each component should have a second horizontal dimension, measured perpendicular to the first dimension, having a maximum value generally equal to $C_2/y$, where $C_2$ is the length of a standard freight container, and y is less than 1, i.e. that the second dimension of the component be less than the length of a standard freight container. It is highly preferable that y be less than or equal to 2, so that at least two such components can be joined together in each transport assembly, and it is even more highly preferable that y be an integer, again to minimize the need for supplemental elements for the transport assembly, e.g. spacers.

Of course, in the general component 10, $x=1$ and $y=1$.

It can be seen that virtually the entire construction system, including all types of construction components described hereinabove, can be shipped to a construction site in the manner of standard freight containers. Specifically, each of the general components 10 can be shipped and handled as a single freight container, while the rake components 200 can be formed into transport assemblies by twos, and the spud well components 202 and 204 can be formed into transport assemblies by fives. Each such transport assembly is likewise shipped and handled in the manner of a standard freight container, but without the need for trying to place these components within actual freight containers. Other small components, such as parts of the bumper 226, can be shipped within standard freight containers, or in any other suitable manner, while the spuds, 216 and 222, being simple pilings, can be shipped in some conventional manner, or in many instances obtained locally at the construction site. When the components have reached the construction site, the various transport assemblies are disconnected or broken down into individual components, and the components are then reassembled to form a structure, only one example of which has been described and illustrated in FIGS. 18–20.

Still other variations will suggest themselves to those of skill in the art. Accordingly, it is intended that the scope of the present invention be limited only by the claims which follow. The order in which steps are recited in the following method claims is not intended to limit the scope of the claims, unless so indicated by terms such as "then," "next," "prior to," etc., or unless the particular steps in question must, of necessity, be performed in a given order.

What is claimed is:

1. A transportation and construction method comprising the steps of:

transporting a plurality of construction components to a construction site at least party way in the manner of ISO standard freight containers;

emplacing a plurality of first such general construction components at the construction site with said first components connected in side-by-side relation to form a first span supported by an underlying earth formation in a fixed position as part of a structure to be built;

then positioning a plurality of second such general construction components with each of said second components adjacent a respective one of said first components, and with said second components connected in side-by-side relation to form a second span;

temporarily supporting said second components in cantilever fashion on said first components to generally locate said second components as part of said structure;

then extending second support means downwardly from said structure adjacent said second components into load bearing engagement with said earth formation in a fixed position as part of said structure;

then interlocking said second components to said second support means for support thereby in a fixed position as part of said structure;

then positioning a plurality of third such general construction components with each of said third components adjacent a respective one of said second components distal said first components, and with said third components connected in side-by-side relation to form a third span;

temporarily supporting said third components in cantilever fashion on said second components to generally locate said third components as part of said structure;

then extending third support means downwardly from said structure adjacent said third components into load bearing engagement with said earth formation in a fixed position as part of said structure;

then interlocking said third components to said third support means for support thereby in a fixed position as part of said structure;

and continuing to enlarge said structure by temporarily supporting additional spans of general construction components in cantilever fashion on already fixed portions of said structure to generally locate said additional spans as parts of said structure, then extending respective support means downwardly from said structure adjacent said additional spans into load bearing engagement with said earth formation in fixed positions as part of said structure, and then interlocking said additional spans to the respective support means for support thereby in fixed positions as parts of said structure, until said structure is enlarged generally to a desired size.

2. The method of claim 1 wherein said components are so positioned by suspending said components from crane means supported on said structure.

3. The method of claim 2 wherein:

each of said first components is a longitudinal component and is so emplaced with both ends thereof supported by said earth formation;

each of said second component is a longitudinal component and is so positioned with one end thereof adjacent one end of the respective first longitudinal component;

said one end of said second longitudinal component is so temporarily supported by locking to said one end of said first longitudinal component;

said second support means is so extended distal said one end of said second longitudinal component;

each of said third components is a longitudinal component and is so positioned with one end thereof adjacent the other end of the respective second component;

said one end of said third component is so temporarily supported by locking to said other end of said second component; and said third support means is so extended distal said one end of said third component.

4. The method of claim 3 wherein said second and third support means are disposed adjacent the other ends of said second and third components, respectively.

5. The method of claim 4 comprising:

connecting a plurality of such first components in side-by-side relation to form a first span so emplaced at said construction site;

so positioning and temporarily supporting a plurality of such second components each with one end adjacent one end of a respective one of the first components and with the second components connected to one another in side-by-side relation to form a second span prior to so extending said second support means; and so positioning and temporarily supporting a plurality of such third components each with one end adjacent the other end of a respective one of the second components and with the third components connected to one another in side-by-side relation to form a third span prior to so extending said third support means.

6. The method of claim 5 wherein each of said components carries a plurality of releasable lock assemblies;

said components are so connected in side-by-side relation to form said spans by means of such lock assemblies; and said components are so temporarily supported in cantilever fashion by means of such lock assemblies.

7. The method of claim 2 wherein said second, third and additional support means comprise piling means extending generally vertically with respect to said components and emplaced downwardly into such load bearing engagement by means on said structure.

8. The method of claim 7 wherein said pilings are so emplaced by driving downwardly through guides carried by said components.

9. The method of claim 8 wherein said guides are incorporated in said general components.

10. The method of claim 8 wherein said guides are incorporated in specialized spud well components connected to said general components.

11. The method of claim 10 comprising:

the steps of supporting said spud well components on said general components in cantilever fashion prior to so extending said pilings;

and interlocking said pilings to said spud well components for such fixed support of the connected general components.

12. The method of claim 2 comprising:

suspending a further construction component by cranelike means on said structure and positioning said further component adjacent a lateral side of said structure;

and supporting said further component in cantilever fashion on said structure.

13. The method of claim 12 wherein said further component is a specialized spud well component, and comprising the step of extending an elongate spud generally vertically through said spud well component.

14. The method of claim 1 wherein at least some of said general components each— has a first gross dimension having a maximum value generally equal to the width of an ISO standard freight container; and has a second gross dimension perpendicular to said first dimension and having a maximum value generally equal to the length of an ISO standard freight container; and is so transported as an individual ISO standard freight container.

15. The method of claim 14 wherein:

others of said components are specialized components each having— a first gross dimension having a maximum value generally equal to $C_1/x$, where $C_1$ is the width of an ISO standard freight container and x is greater than or equal to 1;

a second gross dimension perpendicular to said first dimension and having a maximum value generally equal to $C_2/y$, where $C_2$ is the length of an ISO standard freight container, and y is greater than 1;

a third gross dimension perpendicular to said first and second dimensions;

at least a first side extending in the direction of said first and third dimensions; and said first sides of at least two such specialized components are connected to form a transport assembly which is so transported as an ISO standard freight container.

16. The method of claim 1 comprising:

connecting said first components in side-by-side relation to form said first span prior to so emplacing at said construction site;

connecting said second components in side-by-side relation to form said second span prior to so positioning and temporarily supporting said second components;

and connecting said third components in side-by-side relation to form said third span prior to so positioning and temporarily supporting said third components.

17. The method of claim 16 wherein said first span is so emplaced at said construction site by emplacing first support means comprising pilings, downwardly with respect to said first longitudinal components into load bearing relation with said earth formation, and then interlocking said first span to said pilings for support thereby.

18. The method of claim 17 wherein, after so emplacing said pilings, and prior to so interlocking said first span thereto, said first span is elevated with respect to said pilings.

19. The method of claim 18 wherein said first span is so elevated by jack means cooperative between said pilings and said first longitudinal components.

20. The method of claim 1 comprising the further steps of:

positioning a specialized tapered rake component with its deeper end adjacent an outer portion of said structure; and supporting said rake component in cantilever fashion on said outer portion of said structure.

21. The method of claim 20 comprising interconnecting at least one specialized spud well component between said rake component and the nearest adjacent general component of said structure.

22. The method of claim 1 wherein at least some of said components each has:

a first gross dimension having a maximum value generally equal to $C_1/x$, where $C_1$ is the width of an ISO standard freight container and x is greater than or equal to 1;

a second gross dimension perpendicular to said first dimension and having a maximum value generally equal to $C_2/y$, where $C_2$ is the length of an ISO standard freight container, and y is greater than 1;

a third gross dimension perpendicular to said first and second dimensions;

at least a first side extending in the direction of said first and third dimensions; and said first sides of at least two such components are connected to form a transport assembly which is so transported as an ISO standard freight container.

23. The method of claim 22 wherein:

each of said components carries a plurality of releasable lock assemblies;

said components are so connected to form said transport assembly by means of such lock assemblies; and said components are so temporarily supported in cantilever fashion by means of such lock assemblies.

24. The method of claim 23 wherein:

some of said lock assemblies are male lock assemblies each having a pin member movable between an advanced position in which said pin member protrudes from the respective component and a retracted position in which said pin member lies generally within the gross dimensions of the respective component; and the pin members of the lock assemblies used to connect components to form said transport assemblies are advanced, and the other pin members are retracted, during such transportation.

25. The method of claim 23 wherein said components are directly connected by means of said lock assemblies to form said transport assemblies.

26. The method of claim 23 wherein:

said components of said transport assembly are rake components, each having a bottom graduated from a deep end to a shallow end; and said rake components are connected with the shallow ends adjacent each other, at least in part, by frame means connected to said components so as to extend transversely between the deep ends, generally parallel to the tops of the rake components, to define—together with the connected rake components—a generally rectangular parallelepiped profile.

27. The method of claim 23 wherein said components are releasably interlocked to said support means.

28. The method of claim 23 wherein said components are so locked by said lock assemblies to form beam-like bodies capable of transmitting axial loads, shear loads, and bending moments across the junctures of connected components.

29. The method of claim 23 wherein said transport assembly is disconnected at said construction site and the components thereof are connected to other components, in different configurations, by means of said lock assemblies, as said components are incorporated into said structure.

30. The method of claim 29 wherein said lock assemblies are left engaged after said components have been interlocked to said support means.

31. The method of claim 1 wherein said components are so temporarily supported in cantilever fashion by means of lock assemblies connecting said components so as to form a beam-like bodies capable of transmitting axial loads, shear loads and bending moments across the junctures of the connected components.

32. The method of claim 1 wherein said first component is so supported by said earth formation at least partially by first support means.

* * * * *

UNITED STATES PATENT AND TRADEMARK OFFICE

CERTIFICATE OF CORRECTION

PATENT NO. : 4,890,959

DATED : January 2, 1990

INVENTOR(S) : Alces P. Robishaw and Paul A. Robishaw

It is certified that error appears in the above-identified patent and that said Letters Patent is hereby corrected as shown below:

In column 28, line 63, delete "party" and insert therefor --partly--.

In column 33, line 7, delete "bodies" and insert therefor --body--.

Signed and Sealed this

Fifteenth Day of January, 1991

*Attest:*

HARRY F. MANBECK, JR.

*Attesting Officer*

*Commissioner of Patents and Trademarks*